US011466691B2

(12) United States Patent
Fox et al.

(10) Patent No.: US 11,466,691 B2
(45) Date of Patent: Oct. 11, 2022

(54) FAULT PROTECTION FOR A PUMP-MOTOR ASSEMBLY

(71) Applicant: Franklin Electric Co., Inc., Fort Wayne, IN (US)

(72) Inventors: Kevin Michael Fox, New Haven, IN (US); Amjad Masood, Fort Wayne, IN (US); Benjamin W. Schafer, Garrett, IN (US); Russell Jonathan Bookout, Fort Wayne, IN (US); Andrew Justin Buuck, Fort Wayne, IN (US); Zachary Keith Foster, Spencerville, IN (US)

(73) Assignee: Franklin Electric Co., Inc., Fort Wayne, IN (US)

( * ) Notice: Subject to any disclaimer, the term of this patent is extended or adjusted under 35 U.S.C. 154(b) by 18 days.

(21) Appl. No.: 16/967,185

(22) PCT Filed: Feb. 4, 2019

(86) PCT No.: PCT/US2019/016562

§ 371 (c)(1),
(2) Date: Aug. 4, 2020

(87) PCT Pub. No.: WO2019/152959

PCT Pub. Date: Aug. 8, 2019

(65) Prior Publication Data

US 2020/0362867 A1 Nov. 19, 2020

Related U.S. Application Data

(60) Provisional application No. 62/725,618, filed on Aug. 31, 2018, provisional application No. 62/725,217,
(Continued)

(51) Int. Cl.
*F04D 15/00* (2006.01)
*F04D 13/06* (2006.01)

(52) U.S. Cl.
CPC ..... *F04D 15/0088* (2013.01); *F04D 15/0066* (2013.01); *F04B 2203/0208* (2013.01);
(Continued)

(58) Field of Classification Search
CPC .. F04D 15/0088; F04D 15/0066; F04D 13/06; F04B 2203/0208; F04B 2205/09; F05D 2260/80
See application file for complete search history.

(56) References Cited

U.S. PATENT DOCUMENTS 3,196,679 A * 7/1965 Howland ..... G01F 15/022 73/204.11
5,158,436 A 10/1992 Jensen
(Continued)

FOREIGN PATENT DOCUMENTS

CN 2105576 5/1992
CN 1830131 A 9/2006
(Continued)

OTHER PUBLICATIONS

International Preliminary Report on Patentability received for PCT Patent Application No. PCT/US2019/016552, dated Aug. 20, 2020, 8 pages.
(Continued)

*Primary Examiner* — Connor J Tremarche
(74) *Attorney, Agent, or Firm* — Faegre Drinker Biddle & Reath LLP

(57) ABSTRACT

A fault control protects a pump-motor assembly from monitored faults. The pump-motor assembly includes an electrical motor mechanically coupled to a pump. The fault control determines a speed of the motor. If the speed is determined to be less than a minimum speed, the fault control generates a fault signal to affect the operation of the motor. The fault control can also determine if a phase of the power provided
(Continued)

to the motor is missing based on vibrations sensed by a vibration transducer. The fault control can also determine temperature faults based on signals from two thermocouples, including determination of loss of inlet or discharge flow.

18 Claims, 20 Drawing Sheets

Related U.S. Application Data filed on Aug. 30, 2018, provisional application No. 62/626,555, filed on Feb. 5, 2018.

(52) U.S. Cl.
CPC ..... *F04B 2205/09* (2013.01); *F04D 13/06* (2013.01); *F05D 2260/80* (2013.01)

(56) References Cited

U.S. PATENT DOCUMENTS

| | | | | |
|---|---|---|---|---|
| 6,435,836 | B1 | 8/2002 | Kobayashi | |
| 6,529,135 | B1 * | 3/2003 | Bowers | H02P 29/024 340/648 |
| 9,140,255 | B2 | 9/2015 | Wetherill et al. | |
| 2005/0047933 | A1 | 3/2005 | Ottoboni | |
| 2005/0196285 | A1 * | 9/2005 | Jayanth | H02H 7/08 417/44.11 |
| 2007/0154320 | A1 | 7/2007 | Stiles | |
| 2009/0126100 | A1 * | 5/2009 | Kenoyer | F24H 1/0081 4/559 |
| 2009/0129935 | A1 | 5/2009 | Kunkler | |
| 2010/0047089 | A1 | 2/2010 | Booker | |
| 2010/0293397 | A1 * | 11/2010 | Pham | F04B 49/065 713/300 |
| 2011/0153237 | A1 | 6/2011 | Jonsson | |
| 2011/0182725 | A1 | 7/2011 | Rasmussen et al. | |
| 2012/0037354 | A1 | 2/2012 | McCoy | |
| 2015/0037169 | A1 | 2/2015 | Veltman | |
| 2016/0060802 | A1 | 3/2016 | Harwood | |
| 2017/0089251 | A1 * | 3/2017 | Shimatani | F01P 7/167 |

FOREIGN PATENT DOCUMENTS

| | | |
|---|---|---|
| CN | 200946587 | 9/2007 |
| CN | 202273876 U | 6/2012 |
| CN | 104728123 A | 6/2015 |
| CN | 106015028 A | 10/2016 |
| CN | 107313949 A | 11/2017 |
| DE | 19539395 | 4/1997 |
| DE | 19539395 A1 | 4/1997 |
| GB | 2008873 | 6/1979 |
| WO | 2015022011 | 2/2015 |

OTHER PUBLICATIONS

International Preliminary Report on Patentability received for PCT Patent Application No. PCT/US2019/016562, dated Aug. 20, 2020, 13 pages.
International Search Report and Written Opinion received for PCT Patent Application No. PCT/US2019/016552, dated May 2, 2019, 9 pages.
International Search Report and Written Opinion received for PCT Patent Application No. PCT/US2019/016562, dated Aug. 7, 2019, 18 pages.
International Search Report for PCT/US2019/016562 dated Jul. 8, 2019, 26 pages.
International Search Report for PCT/US2019/016562 dated Aug. 7, 2019, 25 pages.
CN Office Action dated Dec. 14, 2021 for CN Application No. 201980021441.

* cited by examiner

FAULT PROTECTION FOR A PUMP-MOTOR ASSEMBLY

CROSS-REFERENCE TO RELATED APPLICATIONS

This application is a National Stage entry under 35 U.S.C. § 317 of International Application No. PCT/US19/16562, filed on Feb. 4, 2019, which claims the benefit under 35 U.S.C. § 119(e) of U.S. Provisional Patent Applications Ser. No. 62/626,555, entitled VERTICAL BOOSTER PUMP AND SUBMERSIBLE MOTOR ASSEMBLY, filed on Feb. 5, 2018, and of U.S. Provisional Patent Application Ser. No. 62/725,217, entitled VERTICAL BOOSTER PUMP AND SUBMERSIBLE MOTOR ASSEMBLY, filed on Aug. 30, 2018, and of U.S. Provisional Patent Application Ser. No. 62/725,618, entitled FAULT PROTECTION FOR A PUMP-MOTOR ASSEMBLY, filed on Aug. 31, 2018; the entire disclosures of said applications are incorporated herein by reference.

TECHNICAL FIELD

The present disclosure relates to motor and pump fault protections, and more particularly to devices and methods for protecting a pump-motor assembly from monitored faults.

BACKGROUND OF THE DISCLOSURE

Pump systems have been used, among other reasons, to fill tanks, maintain water pressure in pipes, or pump liquids out of deep wells. Such systems include a pump-motor assembly (PMA) in which a motor drives a pump to transfer liquids from one reservoir to another. A motor controller or motor drive usually controls the operation of the motor. A booster pump is a type of PMA configured to increase the pressure of a liquid, such as water, that is being pumped. For example, tall buildings may use booster pumps at spaced-apart locations, such as every several floors, to provide adequate water pressure to all floors of the building. These tall-building booster pumps are therefore installed near living spaces and in areas with limited overhead clearance. Noise associated with conventional open-air booster pumps may draw complaints from nearby residents, and limited overhead clearance may limit options for submerged pump configurations. To the extent that submerged pumps are used, maintenance costs may be higher compared to open-air pumps.

The motor drive is typically a variable speed drive configured to maintain fluid pressure at a desired setpoint. Variable speed drives are installed by technicians in the field and as technology evolves variable speed drives are becoming more configurable. Various faults, such as insufficient cooling, flow blockage, mechanical misalignment, etc., can cause a PMA to fail. Additionally, the variable speed drive may be configured incorrectly and thus cause the PMA to operate within a range of speeds which generate low flows and can damage the motor or pump if the low flows are insufficient to cool or lubricate the motor or pump.

A need exists for a reliable and cost-effective approach to protecting pump systems from faults.

SUMMARY OF CLAIMED EMBODIMENTS

Embodiments of the disclosure provide a fault control and a method to protect a pump-motor assembly from faults by monitoring signals from various transducers associated with the pump-motor assembly to detect the presence of fault conditions. The pump-motor assembly includes a motor coupled to a pump, and transducers or sensors to detect characteristics of the pump-motor assembly. Characteristics may include temperature, current, vibration, and other characteristics, such as frequency, derived the sensed parameters. If one or more such conditions are detected, the fault control generates signals to affect the operation of the pump-motor assembly and to alert a user of the detected fault conditions. In some embodiments, the fault control is mounted on the pump-motor assembly. In some variations, the fault control is electrically connected to communicate alarm signals and stop/run signals to a motor drive. In other variations, the fault control is electrically connected to communicate alarm signals to the motor drive and stop/run signals to a circuit breaker to stop the motor. The fault control can also be positioned separately from the PMA while electrically coupled to transducers or sensors mounted on the PMA.

Advantageously, a submersible motor enables more quiet operation of the booster pump. Furthermore, because liquids transfer heat more efficiently than air, use of a submersible motor enables detection of low or no flow conditions in a sufficiently timely manner to prevent damage to the motor or the pump.

In one form thereof, the present disclosure provides a fault control for a pump-motor assembly including a motor mechanically coupled to a pump, the fault control comprising: a current transformer adapted to sense current flowing through a power line powering the motor; and a controller structured to determine a speed of the motor based on the sensed current and to generate a fault signal if the speed is less than a minimum speed that is greater than zero.

In another form thereof, the present disclosure provides a fault control for a pump-motor assembly including a motor mechanically coupled to a pump and powered by a motor drive supplying power comprising three phases to the motor, the fault control comprising: a vibration transducer mounted onto the pump-motor assembly; and a controller structured to determine characteristics of a vibration signal generated by the vibration transducer and to detect, based on the characteristics, if at least one of the three phases is missing.

In yet another form thereof, the present disclosure provides method of monitoring faults for a pump-motor assembly including a motor mechanically coupled to a pump. The method is implemented by a fault control mechanically mounted onto the pump-motor assembly and including a controller and a vibration sensor. Also mounted onto the pump-motor assembly are two thermocouples and a current transformer magnetically coupled to a power line supplying the motor. The controller determines a speed of the motor by sensing the signal from the current transformer and based thereon determining a fault if the speed is below a minimum speed. The controller may determine a temperature fault if the temperatures sensed by the thermocouples exceed maximum temperature thresholds, or if the difference between the temperatures exceeds a threshold, or if the rate of change of at least one of the temperatures exceeds a threshold. The controller may determine a loss of phase fault if the vibration sensor indicates excessive vibration, by comparing signals from three axis and determining that the amplitude of one signal is at least 50% greater than the average of the amplitudes of the other signals, or if the amplitude of one signal is at least twice the amplitude of one of the other signals. If a fault is determined, the controller sends an alarm signal to a motor drive supplying power to the motor, or sends a stop signal to the motor drive or a circuit breaker to stop operation of the motor.

BRIEF DESCRIPTION OF THE DRAWINGS

In the drawings, corresponding reference numbers indicate corresponding parts throughout several views. Unless stated otherwise the drawings are not proportional.

DETAILED DESCRIPTION

Embodiments of the disclosure provide a fault control and a method to protect a pump-motor assembly from faults by monitoring signals from various transducers associated with the pump-motor assembly to detect the presence of fault conditions. If one or more such conditions are detected, the fault control generates signals to affect the operation of the pump-motor assembly and to alert a user of the detected fault conditions. In some embodiments, the fault control is mounted on the pump-motor assembly and electrically connected to a motor drive to communicate alarm signals and stop/run signals. In some embodiments, the fault control is mounted on the pump-motor assembly and electrically connected to a motor drive through a circuit breaker to communicate alarm signals to the motor drive and stop/run signals to the circuit breaker.

Figure 1:
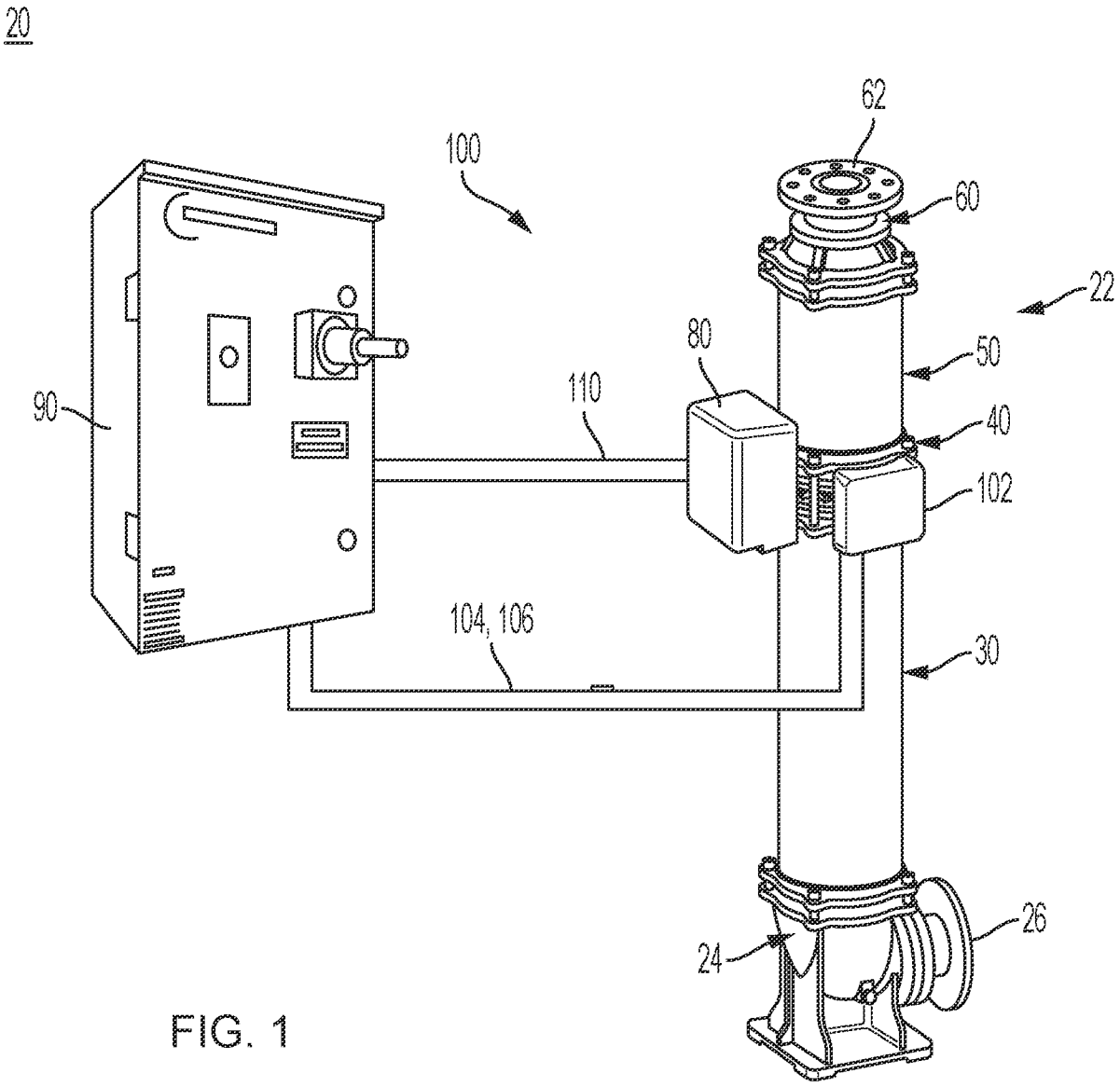
FIG. 1 is a diagram of an embodiment of a pump control system including a pump-motor assembly.
Figure 2:
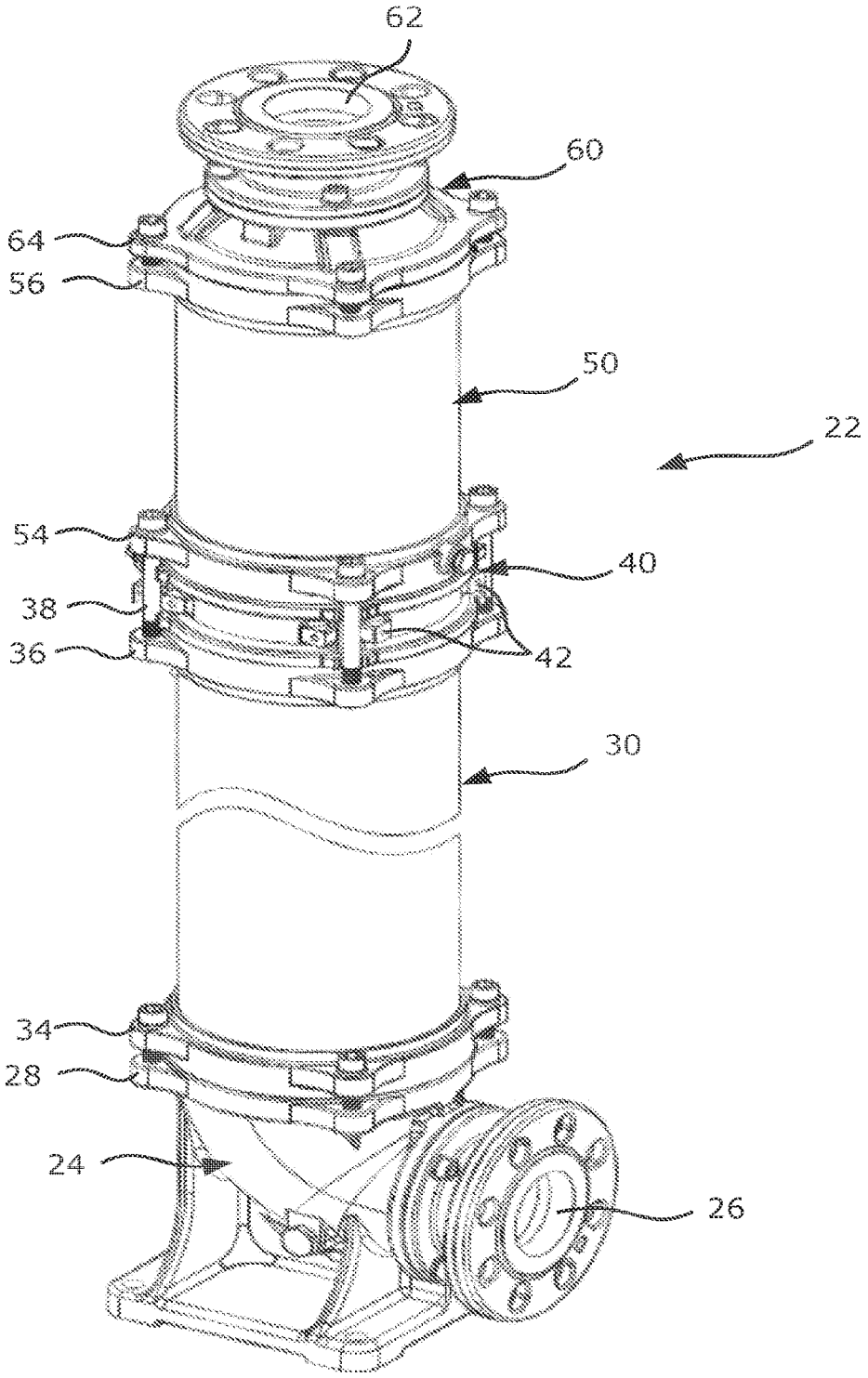
FIGS. 2 and 3 are a perspective and cross-sectional views of an embodiment of the pump-motor assembly of FIG. 1.
Figure 3:
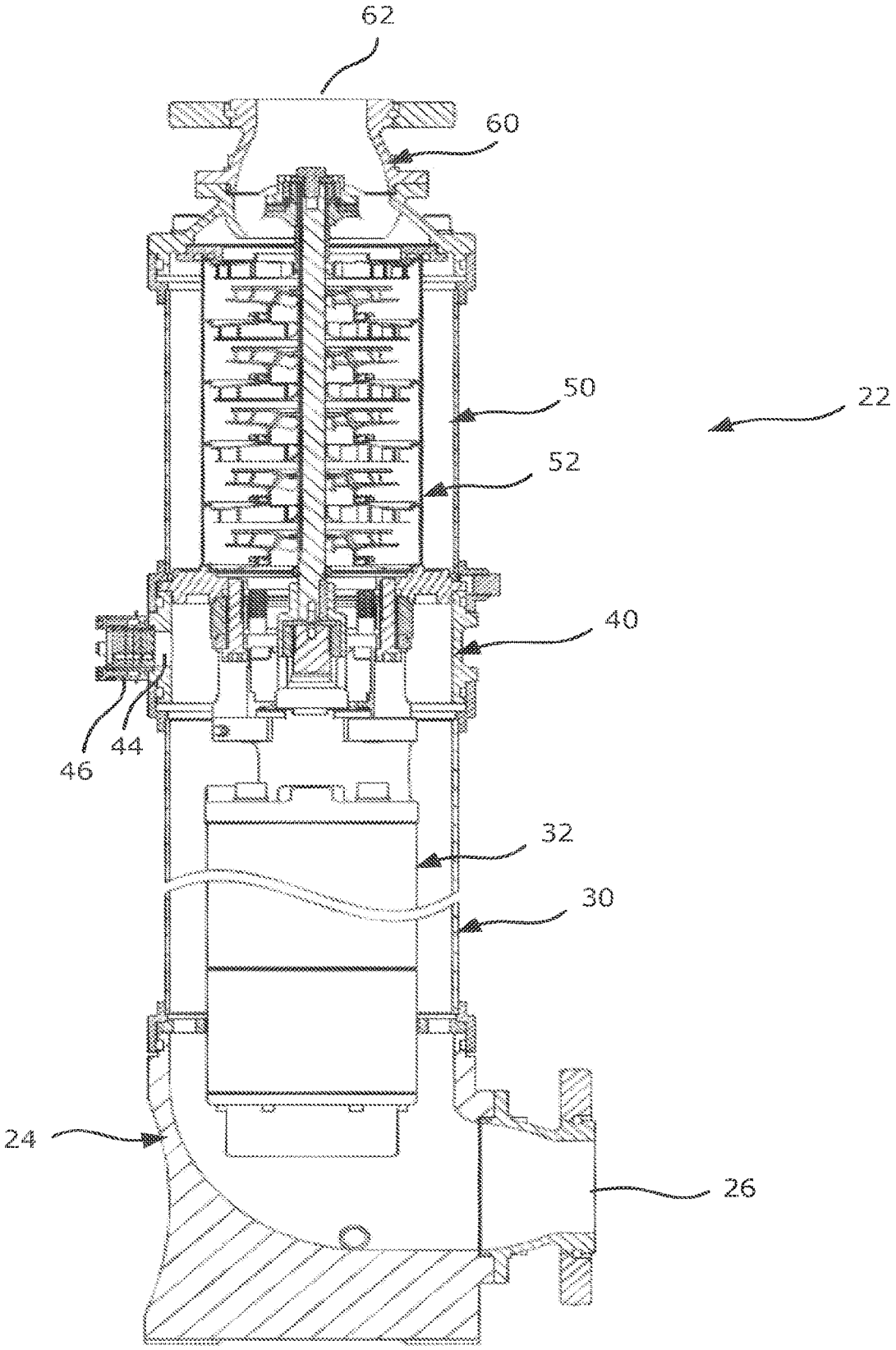

FIG. 1 is a diagram of an embodiment of a pump control system 20 including a PMA 22, also shown in FIGS. 2 and 3, a motor drive 90, and a fault control system 100. PMA 22 includes a motor section 30 including a motor 32 (shown in FIG. 3) and a pump section 50 including a pump 52 (shown in FIG. 3). An inlet adapter 24 connected to motor section 30 has an inlet port 26, and a discharge adapter 60 connected to pump section 50 has a discharge port 62. Motor section 30 is intermediate to inlet port 26 and pump section 50, while pump section 50 is intermediate to motor section 30 and discharge port 62. A housing adapter 40 is provided between motor section 30 and pump section 50 to provide a mounting location for a junction box 80 and a fault control 102. Pump 52 is driven by motor 32 which is powered by motor drive 90 via power lines 110 including power conductors 110A-C (shown in FIG. 8). Two or more power conductors may be used to provide single, two, or three phase power to motor 32. The power conductors are connected to the motor in junction box 80. PMA 22 may be fluidly coupled to assume a vertical or a horizontal orientation.

Fault control system 100 includes fault control 102, transducers (discussed below), alarm signal wires 104, and stop/run control wires 106. In operation, fault control 102 evaluates signals from the transducers and determines whether a fault occurred, and whether the fault merits shutting down the motor. If a fault occurred, fault control 102 transmits an alarm signal to motor drive 90. If the fault merits shutting down the motor, fault control 102 transmits an emergency or stop signal over stop/run control wires 106 to motor drive 90 (as shown), or to a circuit breaker intermediate motor drive 90 and PMA 22 (best seen in FIG. 13). Conditions that merit shutting down or only indicating an alarm are discussed in more detail with reference to FIGS. 15 and 16.

FIGS. 2-5 and 6A-6C are views of PMA 22 and a fault control. Motor and pump sections 30 and 50 are connected to inlet and discharge adapters 24 and 60. Between motor section 30 and pump section 50 is housing adapter 40. Inlet adapter 24 has a flange 28 connected to a flange 34 of motor section 30. Motor section 30 has a flange 36 secured to a flange 54 of pump section 50 by bolts 38, retaining housing adapter 40 therebetween. Flange 56 of pump section 50 is secured to flange 64 of discharge adapter 60, thereby connecting pump section 50 to discharge adapter 60. Housing adapter 40 includes a plurality of threaded holes 42 provided to enable securement of junction box 80 and/or fault control 102 to PMA 22. In operation, PMA 22 is cooled by liquid pumped through from inlet port 26 to discharge port 62. The motor may be submersible, and the liquid may lubricate motor bearings and cool the motor.

Figure 4:
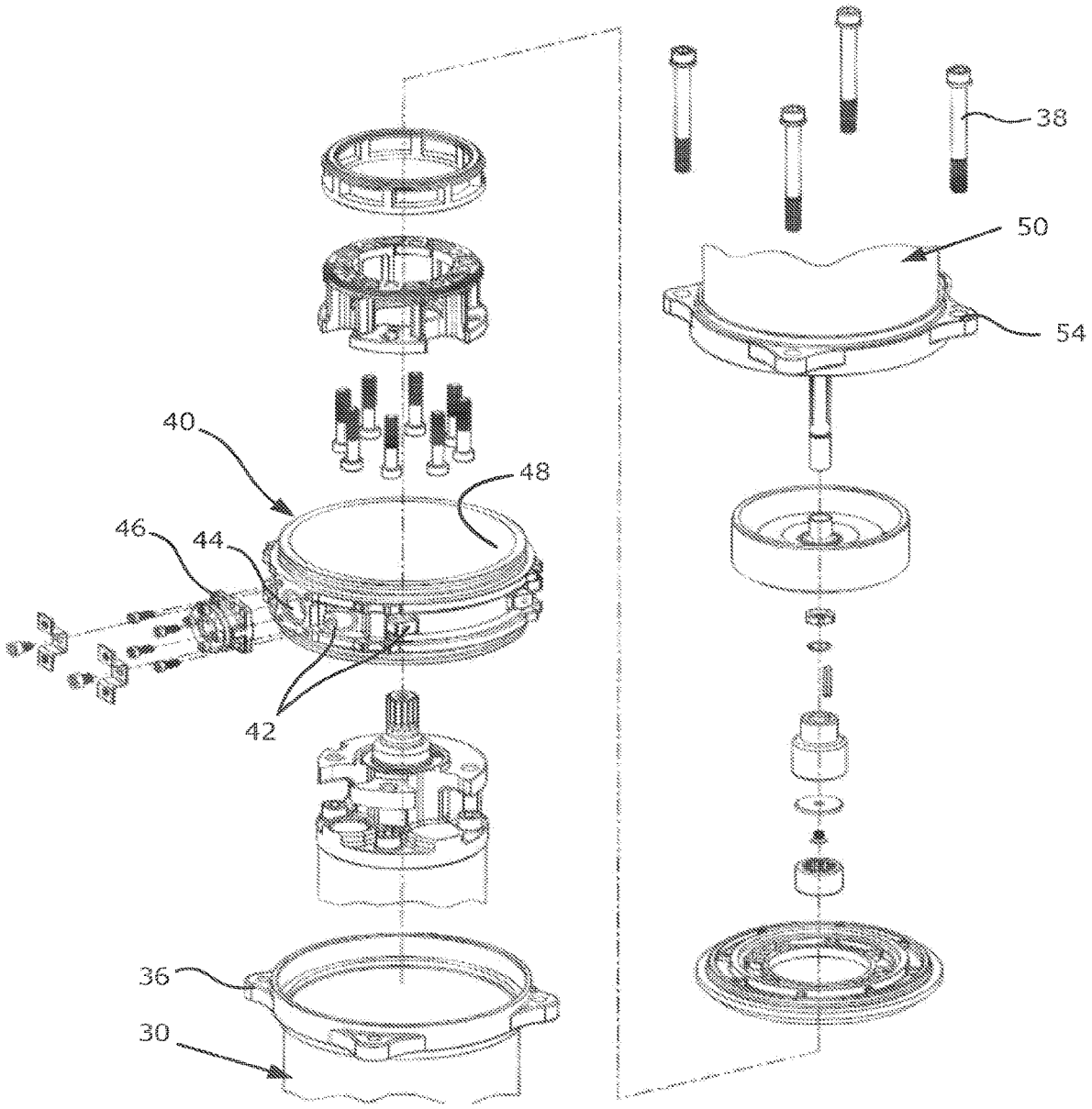
FIG. 4 is an exploded sectional view of the pump-motor assembly of FIG. 1 showing a housing adapter according an embodiment of the pump-motor assembly of FIG. 1.
Figure 5:
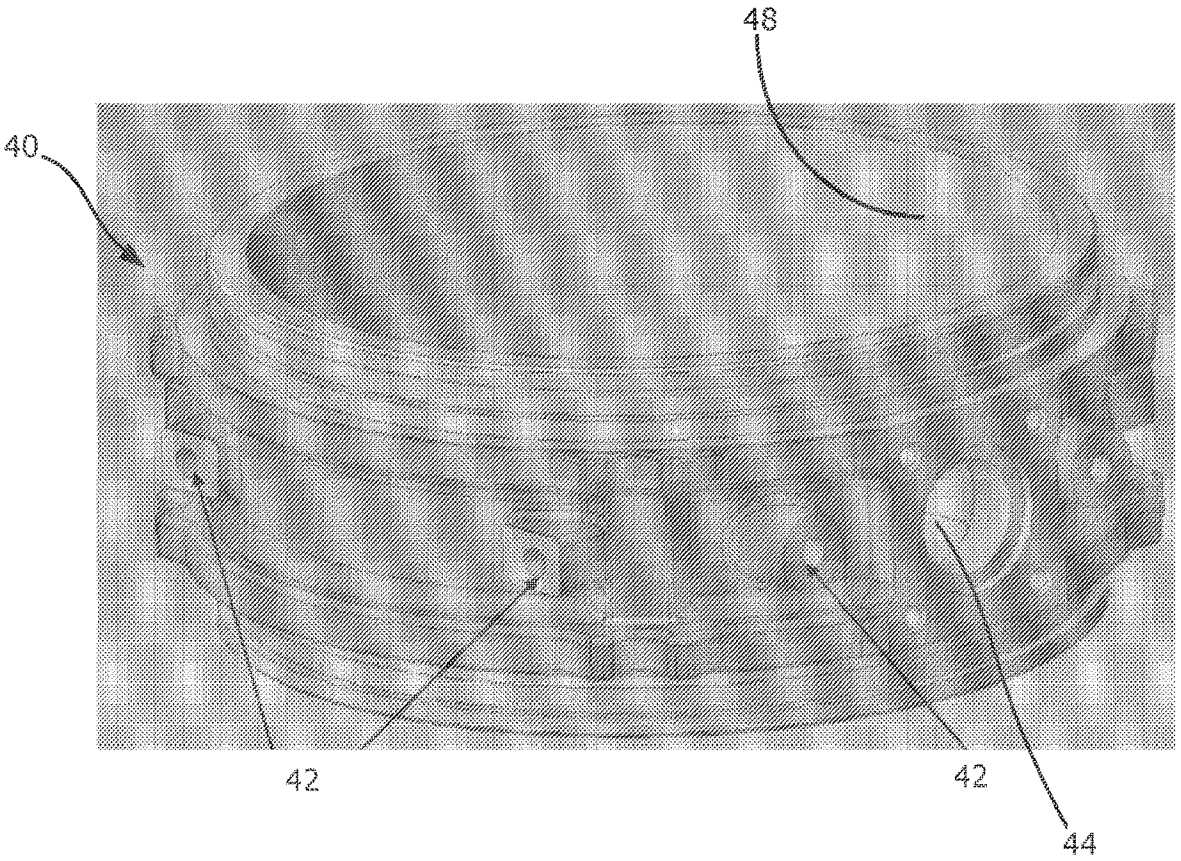
FIG. 5 is a perspective view of the housing adapter depicted in FIG. 4.
Figure 17:
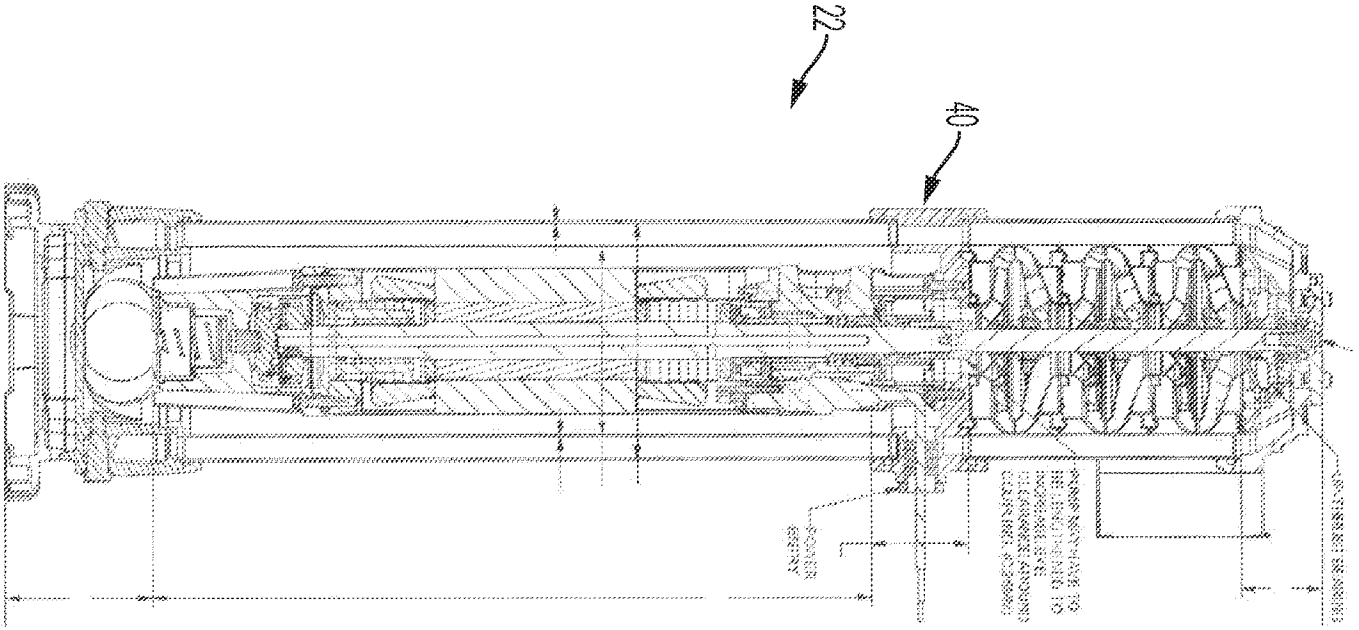
FIGS. 17 and 18 are alternative depictions of a housing adapter.
Figure 18:
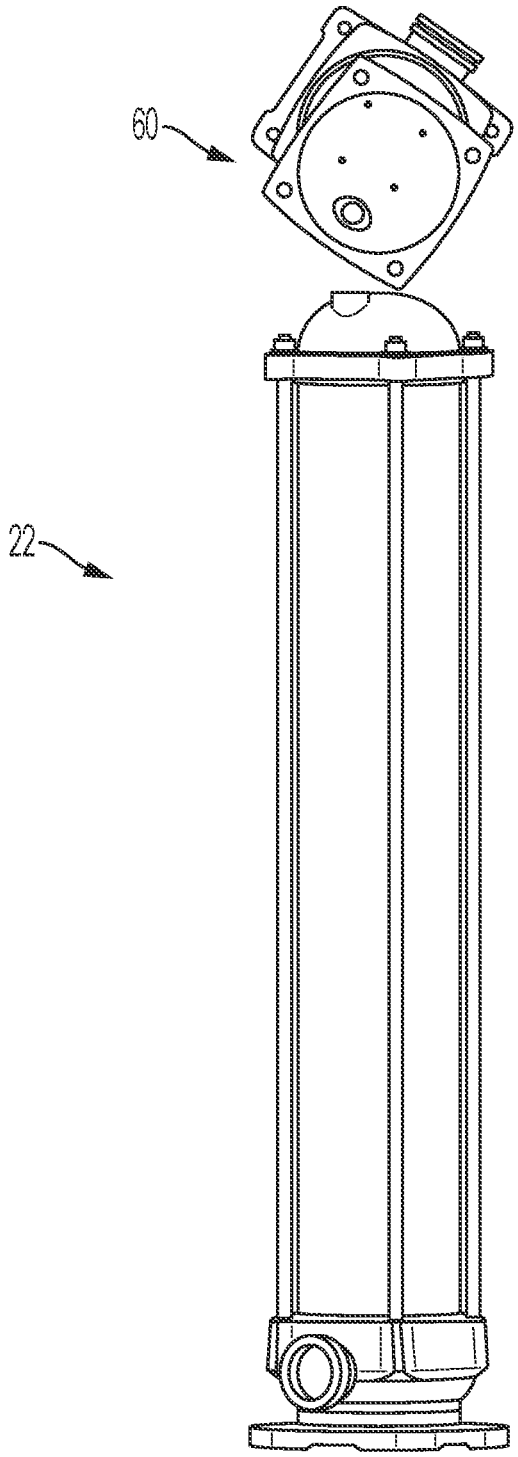

Housing adapter 40 comprises a cylindrical wall 48 having therein a wiring hole 44 suitable to attach a junction box coupler 46 (shown in FIGS. 3 and 4). Power conductors pass from inside motor section 30 and/or pump section 50 through wiring hole 44 and junction box coupler 46 to junction box 80 where the motor conductors are joined with the power conductors from motor drive 90. In the present embodiment, the transducers are located on external surfaces of the PMA, junction box 80, or fault control 102, therefore the signal conductors do not need to pass through the PMA housing. In variations of embodiments of housing adapter 40, one or more transducers may be positioned within the PMA housing and a separate signal conductor hole may be provided along with a separate fault control coupler for electrically coupling fault control 102. In other variations one or more wiring holes are provided through the inlet adapter, discharge adapter, motor section or pump section. For example, the motor and pump sections comprise cylindrical housings and a wiring hole can be positioned in each or in one of the cylindrical housings. In a further example, the cylindrical housings are coupled at each end to flange adapters comprising the flanges, and wiring holes are positioned in the flange adapters. See also FIGS. 16 and 17. In other embodiments, for example those shown in FIGS. 17 and 18, a housing adapter may comprise a collar positioned over a cylindrical PMA housing, as shown in FIG. 17, or may be incorporated with the discharge adapter in a one-piece component of PMA 22, as shown in FIG. 18.

Figure 6A:
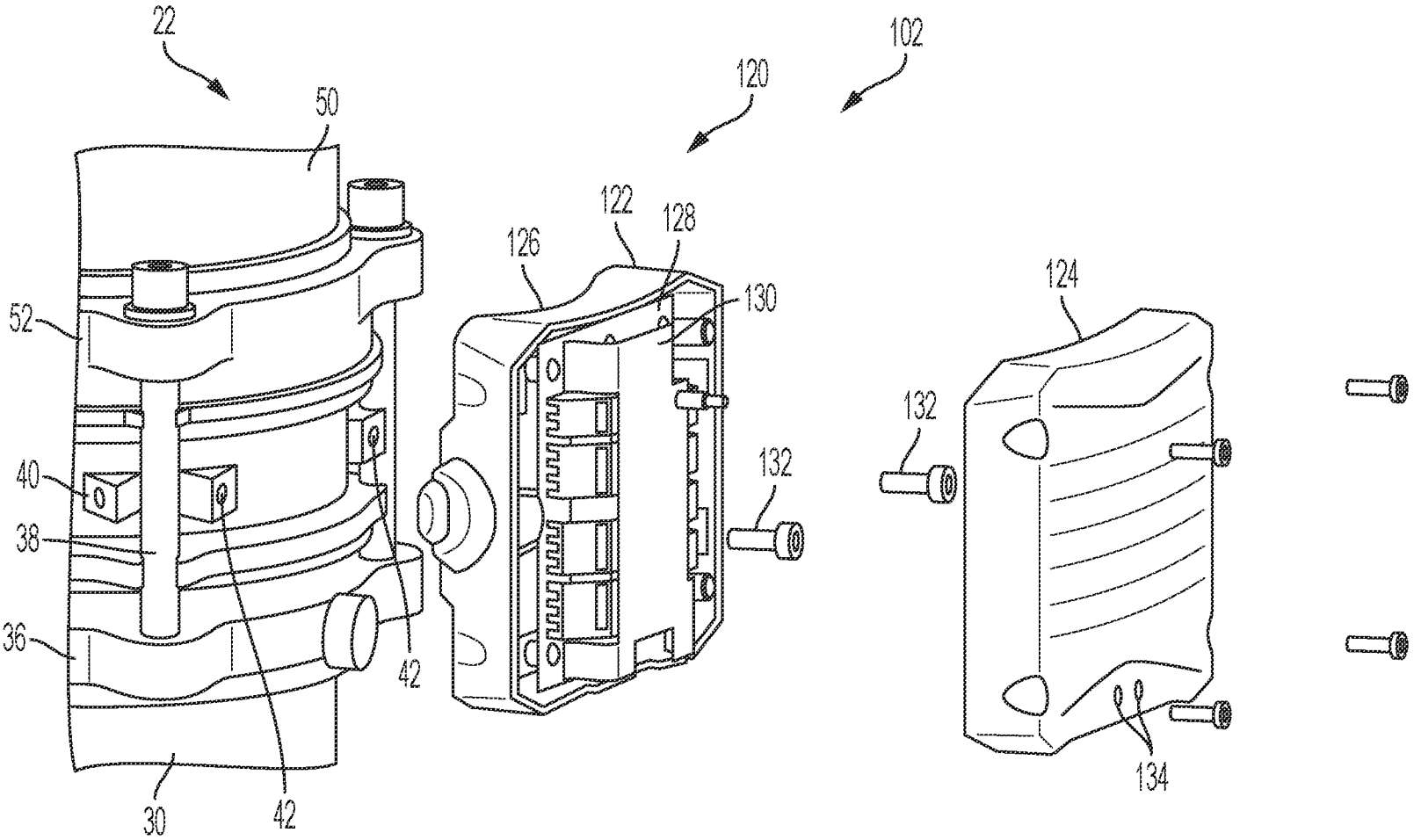
FIG. 6A is an view of the housing adapter of FIG. 5 and a fault control.
Figure 6B:
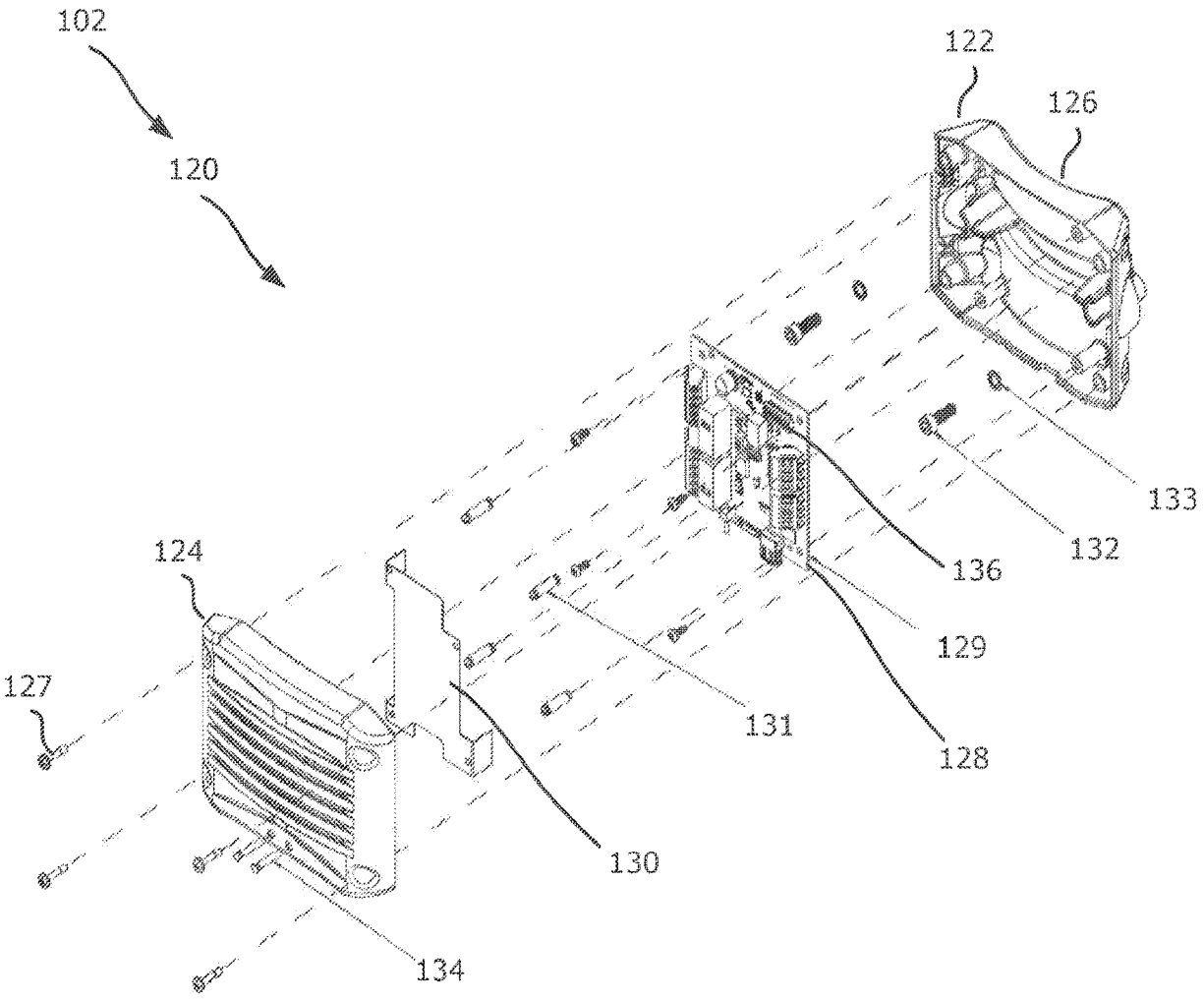
FIGS. 6B and 6C are views of the fault control of FIG. 6A.
Figure 6C:
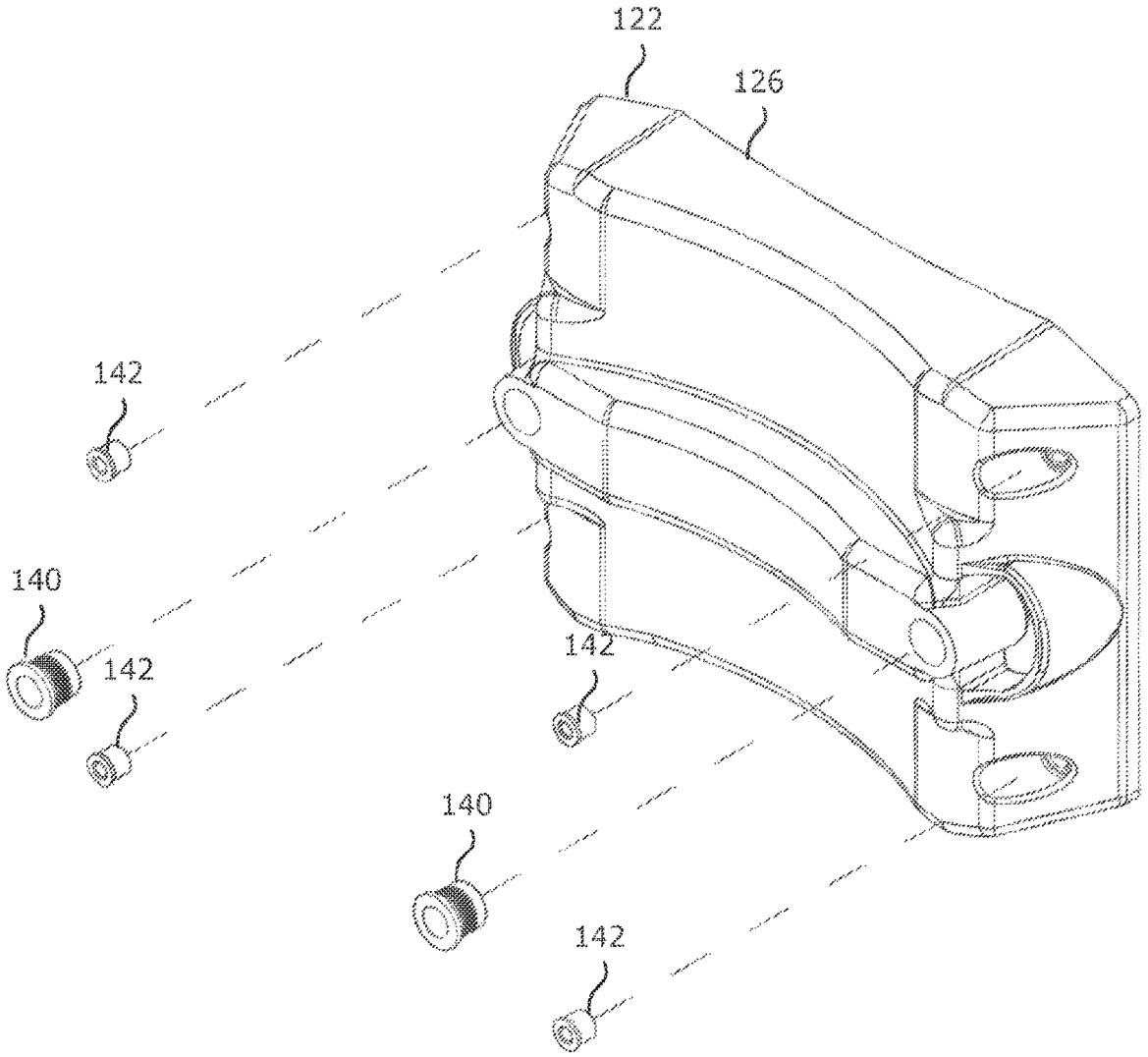

Referring to FIGS. 6A-6C, fault control 102 comprises a housing 120 having a housing body 122 and a housing cover 124, a circuit board 128, and a shield 130 intermediate circuit board 128 and housing cover 124. Shield 130 is spaced from circuit board 128 by spacers 131. Spacers 131 may be made of any suitable material, including polymers and metals. Housing body 122 has, optionally, a curved back wall 126 configured to securely mount housing 120 to adapter 40 with bolts 132 secured to threaded holes 42 located in adapter 40. Washers 133 may be provided to prevent loosening of bolts 132 due to vibration. Housing cover 124 can be secured to housing body 122 with screws 127, as shown, which pass through holes in housing cover 124 and are secured to threaded openings in housing body 122. Optionally, internally threaded metal bushings 142 (FIG. 6C) can be secured to holes in housing body 122 to provide the threaded openings in a firmer fashion. Bushings 142 may comprise distal (or externally facing) shoulders to provide an even more secure means of attaching housing cover 124 to housing body 122. Bushings 142 may be secured to housing body 122 in any number of ways, including ultrasonic welding, press fitting, heat sinking, adhesive bonding, etc. The edges of bushings 142 may be knurled to increase bonding strength. A pair of LEDs 134 are visible on housing cover 124. As shown, protruding frusto-conical tabs extend from a surface of housing body 122 to support circuit board 129. The tabs may be replaced by longer metal bushings 142 to increase vibration transfer even more.

An advantage of positioning fault control 102 on PMA 22 is the reduced length of the conductors necessary to connect the transducers to fault control 102. Another advantage is that a vibration sensor 136 may be mounted on circuit board 128, as shown in FIG. 6B. As shown in FIG. 6C, a pair of rigid stand-offs 140 may be provided to reduce vibration dampening by housing body 122 and thereby obtain a stronger vibration signal. In one example, stand-offs 140 are metallic, e.g. iron, brass, aluminum, copper, or steel, and have distal shoulders (as shown). Thus, bolts 132 pass through stand-offs 140 and make direct contact with adapter 40 with stand-offs 140 therebetween. Stand-offs 140 prevent direct contact of housing body 122 with adapter 40. Tightening bolts 132 onto adapter 40 increases contact on both ends of stand-offs 140 and thereby the transfer of vibration from adapter 40 to vibration sensor 136. Optionally, stand-offs 140 can be secured to holes in housing body 122 in any number of ways, including ultrasonic welding, press fitting, heat sinking, adhesive bonding, etc. The edges and/or cylindrical surface of each stand-off 140 may be knurled to increase bonding strength.

Of course fault control 102 may be mounted separately from PMA 22, for example on a building wall adjacent to PMA 22. As the conductor length increases, so do does signal attenuation and noise. In another embodiment, to combat the negative aspects of conductor length a repeater box may be mounted on PMA 22. The repeater box may include circuits configured to receive and digitize the signals on the signal conductors, e.g. a voltage regulator and an integrated circuit including analog-to-digital converters and, optionally, a known communications controller to transmit the data corresponding to the digitized signals to a remotely located fault control 102. Communications controllers may include a Modbus controller, an RS-485 controller, or any other known controller configured to transmit data. In a variation of the present embodiment, the functionality of fault control 102 is incorporated in motor drive 90, which includes a corresponding communications controller to receive the data and act upon it. In one example, the protective features are factory-set and not field programmable.

Figure 7:
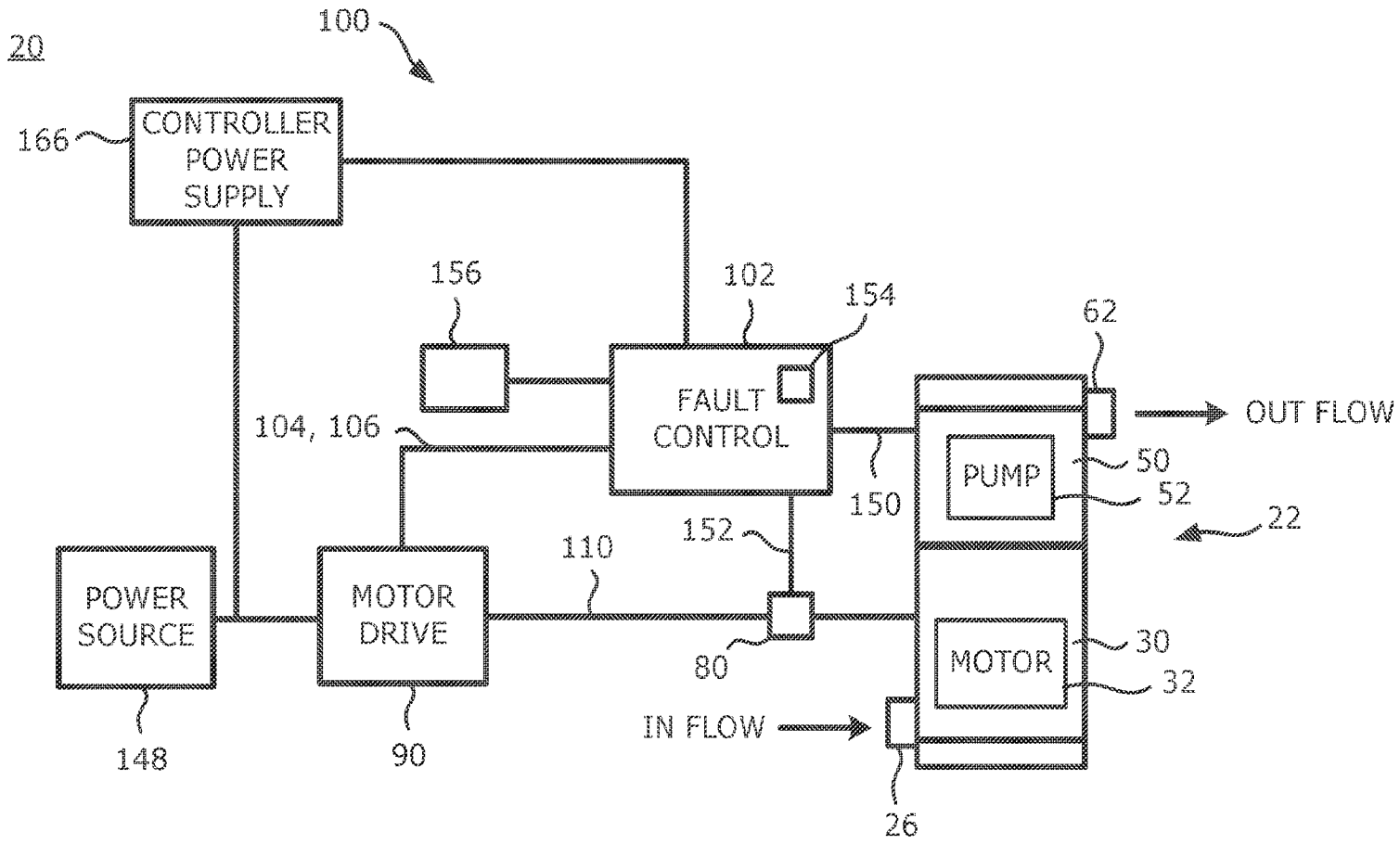
FIGS. 7 and 8 are block diagrams of the pump control system of FIG. 1.
Figure 8:
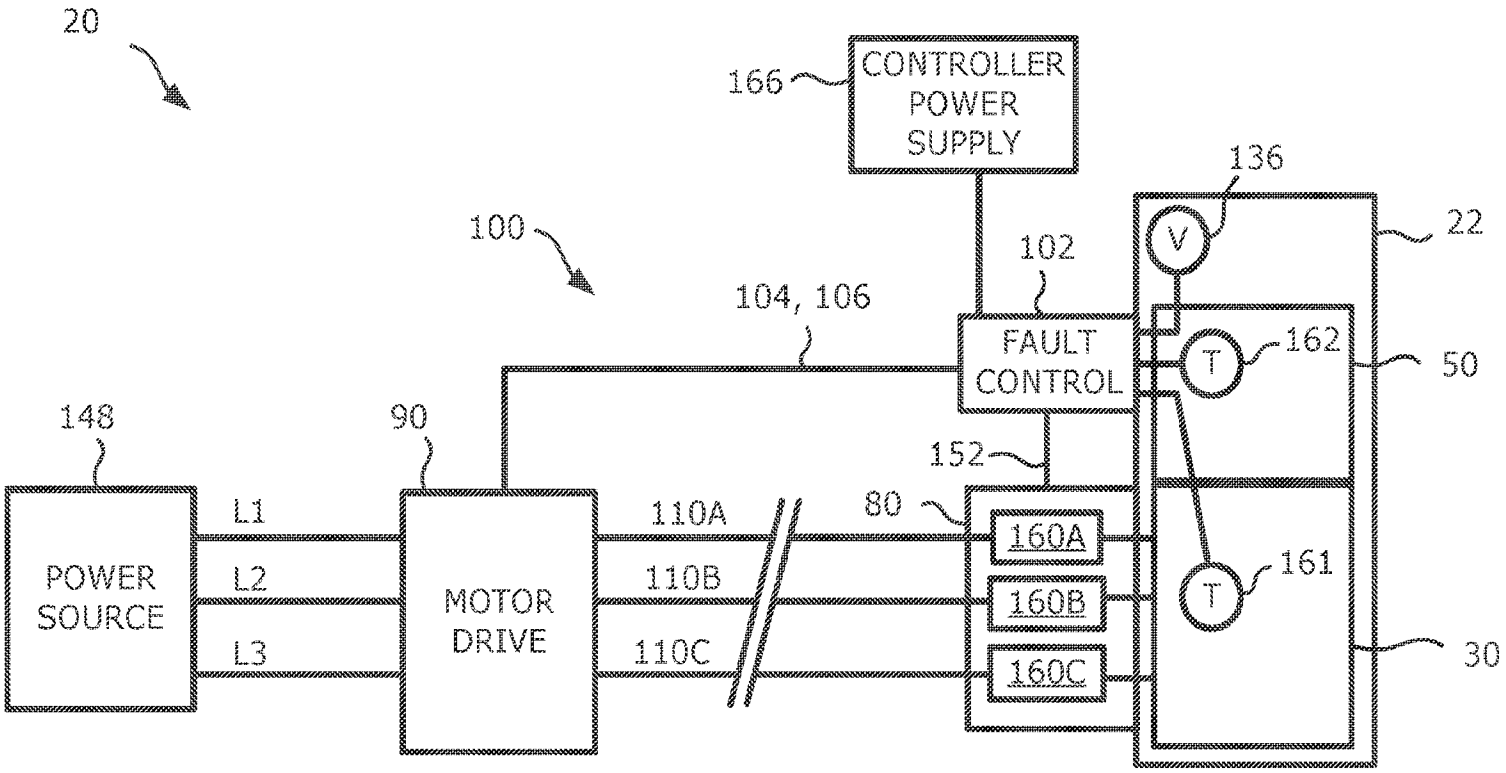

FIGS. 7 and 8 are block diagrams of pump control system 20. Motor drive 90 receives constant frequency power from a power source 148, which may be a generator, a power-grid from a power utility company, or any other alternating current (AC) power source. Motor drive 90 includes a conventional inverter, power module, and drive controller configured, collectively, to convert the constant frequency AC power to a variable frequency, in a manner well known in the art, suitable to control the speed of motor 32 and pump 52, which is mechanically coupled thereto. The motor power is supplied via power lines 110 from motor drive 90 through junction box 80 to motor 32. Fault control 102 detects faults by monitoring signals from various transducers associated with PMA 22, including without limitation temperature and vibration signals. Signal conductors 150 provide the transducer signals to fault control 102. Fault control 102 also detects faults by monitoring signals from a plurality of current transformers (CTs) 160A-160C (shown in FIG. 8) located in junction box 80. Signal conductors 152 provide the CT signals to fault control 102. Fault control 102 generates an alarm signal and transmits the alarm signal over alarm signal wires 104 to motor drive 90 responsive to detecting a fault. The alarm signal sent to motor drive 90 may trigger an alarm on motor drive 90 to alert an operator. If the detected fault is more serious (e.g., meriting a shut-down of motor section 30), fault control 102 also transmits an emergency or stop signal over stop/run control wires 106 to affect the operation of motor 32. For example, the stop signal may be adapted to stop motor drive 90 from supplying power to motor section 30. When the cause of the detected fault has been resolved or fixed, fault control 102 can transmit a run signal over stop/run control wires 106 to resume running of motor drive 90 to supply power to motor 32.

Fault control 102 can display the detected fault via indicators 154. In some variations of the present embodiment, indicators 154 may comprise light emitting diodes (LEDs) that flash different colors to indicate different fault types. In other variations, indicators 154 may comprise speakers or buzzers that emit different audible sounds to indicate different fault types. Additionally, fault control 102 may display the detected fault via a human machine interface (HMI) 156. HMI 156 allows a technician or user to view and diagnose the detected fault. Examples of HMI 156 include a digital display wired to fault control 102, or a mobile device wirelessly coupled to fault control 102 using known wireless communications protocols such as Bluetooth, Zigbee, and WiFi, or a combination display/controller configured to communicate via a standard Modbus protocol.

Fault control 102 may be powered by a power supply 166 (shown in FIG. 12) fed from power lines L1-L3 and including a transformer to step-down the line voltage, e.g. from 460 VAC to 24 VAC, in which case fault control 102 includes suitable rectification and regulation circuits to convert AC power to direct current (DC) power having a low voltage, for example in the range of 5-30 DC volts. In a variation of the present embodiment, power supply 166 includes a rectification circuit. Low voltage conductors convey the supply voltage, e.g. 24 VAC or 24 VDC, to fault control(s) 102. In another variation of the present embodiment, fault control 102 may be powered by a power converter (not shown) fed from power lines 110, in which case fault control 102 includes suitable circuits to convert AC power to direct current (DC) power having a low voltage, for example in the range of 5-30 DC volts. Suitable circuits to convert AC to DC power include rectification circuits, voltage regulators, and other known circuits.

Referring to FIG. 8, power lines L1, L2 and L3 provide three phase AC power from power source 148 to motor drive 90. CTs 160A-160C, located in junction box 80, generate signals corresponding to the currents in conductors 110A-110C, respectively, and provide the CT signals to fault control 102 via signal conductors 152. Fault control 102 determines a speed of motor section 30 based on the CT signals and generates a fault signal if the speed is less than a minimum speed that is greater than zero. An exemplary minimum speed is 20 Hertz. Another exemplary minimum speed is 15 Hertz.

Fault control 102 may comprise a fault controller 230 (shown in FIG. 15) with a memory 232 having programming instructions embedded therein to cause fault controller 230 to determine the time, t, between pulses on one of the CT signals and based on the time determine the frequency, f=1/t, and thereby the speed, of the motor. Fault controller 230 may comprise an analog-to-digital converter (ADC) or an ADC may be provided together with common circuitry to shape, e.g. clip, square, amplify and/or electrically isolate, the CT signal. The common circuitry may be comprised in a CT signal interface 240 (shown in FIG. 15). The minimum speed is set to ensure adequate pumping to provide sufficient cooling, and lubrication to motor bearings, and the like, to prevent damage. The fault signal may be an alarm signal if the speed approaches the minimum speed and a stop signal if the speed falls below the minimum speed. Alternatively, the fault signal may be an alarm signal if the speed falls below the minimum speed and a stop signal if the speed remains below the minimum speed for a predetermined period of time. Based on the CT signals, fault control 102 can also determine if a phase is missing from the three phase AC power supplying motor section 30. Fault control 102 may detect the missing phase by determining that a voltage of one of the CT signals is missing or below a low voltage threshold.

A temperature transducer 161 is disposed in or positioned adjacent to motor section 30 to measure a temperature of motor section 30. Similarly, a temperature transducer 162 is disposed in or positioned adjacent to pump section 50 to measure a temperature of pump section 50. Fault control 102 determines a temperature difference based on the temperature signals from temperature transducers 161, 162. In one example, fault control 102 identifies a flow loss based on the temperature difference, where a positive temperature difference indicates a loss of inlet flow and a negative temperature difference indicates a loss of discharge flow. Fault control 102 identifies the flow loss when the absolute amplitude of the temperature difference exceeds a temperature difference threshold. Of course the temperature signals may be inverted so that a positive temperature difference indicates a loss of discharge flow and a negative temperature difference indicates a loss of inlet flow. Loss of flow is a fault that merits shutting down of motor 32 to protect the motor bearings.

Figure 9:
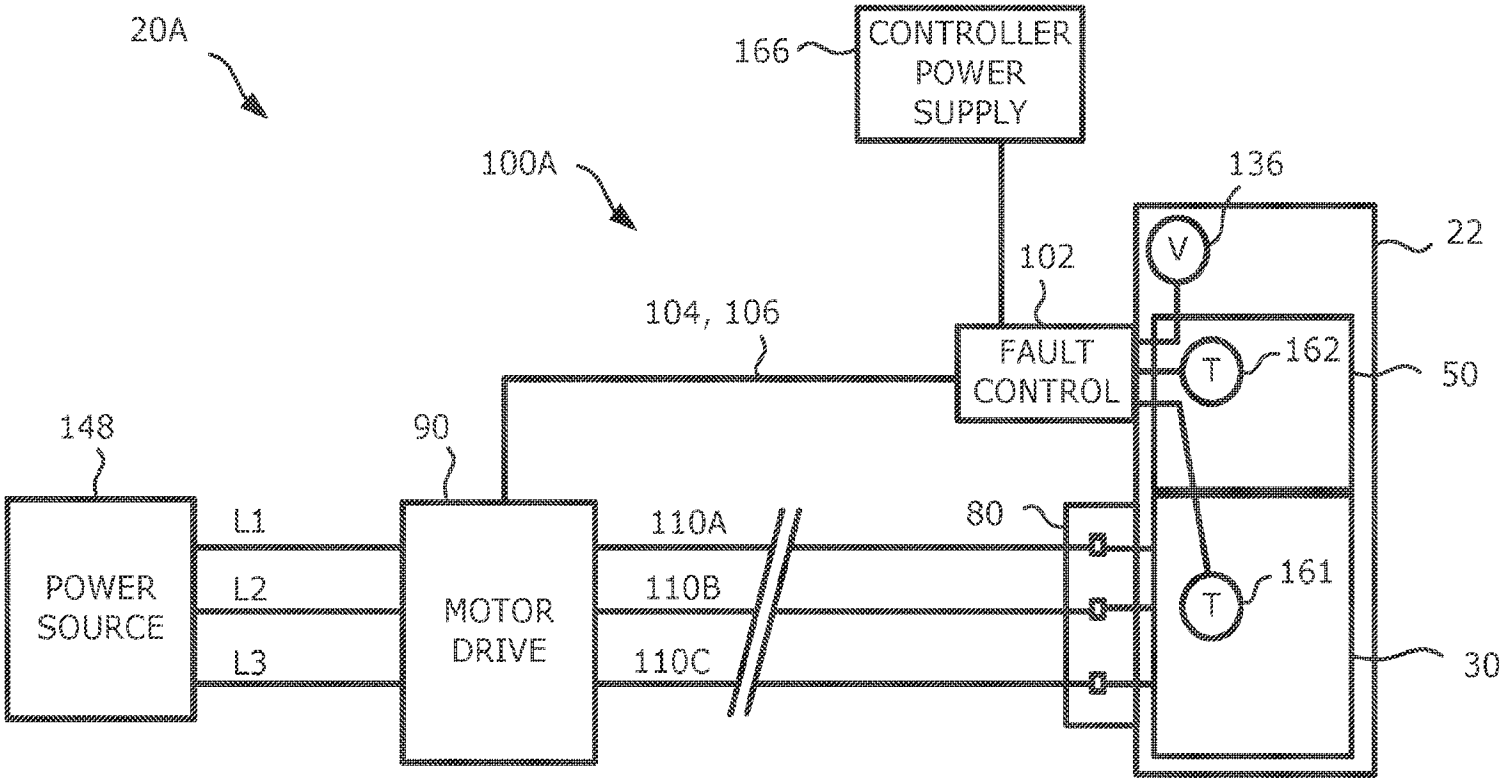
FIGS. 9 and 10 are block diagrams of alternative variations of the pump control system of FIG. 1.
Figure 10:
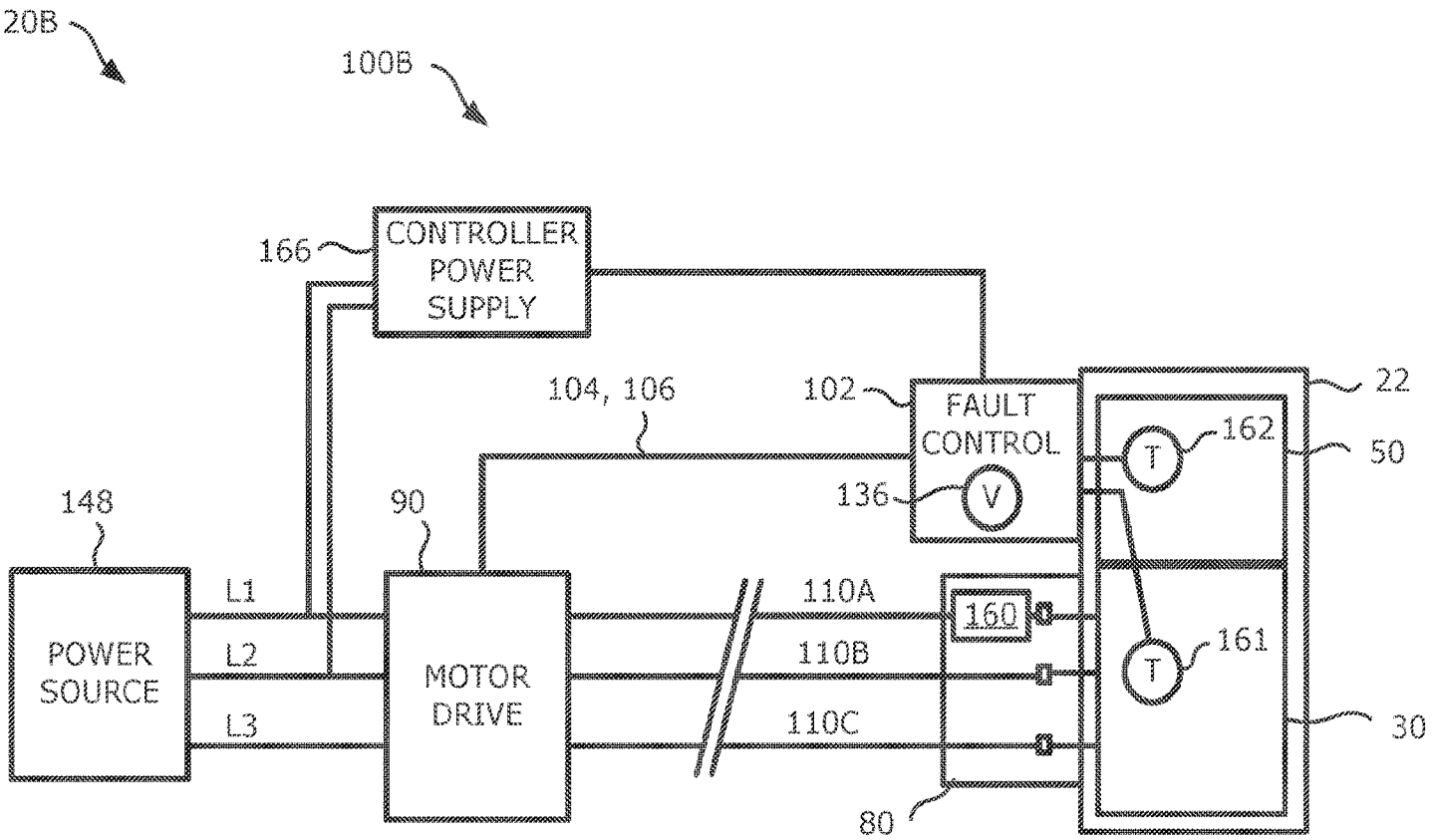

FIGS. 9 and 10 are block diagrams of variations of pump control system 20, denoted as 100A with fault control system 100A, and as 100B with fault control system 100B. Pump control systems 100A and 100B differ from pump control system 20 in that they do not include CTs 160A-160C in junction box 80. Instead, a vibration transducer 136 is used by pump control systems 100A and 100B to determine a speed of motor section 30 and/or if a phase is missing. Vibration transducer 136 is disposed in or on PMA 22 to measure a magnitude of a vibration of PMA 22. In one example, vibration transducer 136 is a three-axis accelerometer, where vibrations are sensed as accelerations. Fault control 102 determines a speed of motor 32 based on an amplitude of the vibration signal from vibration transducer 136, e.g. the RMS value of the signal, which increases proportionally to speed. Since misalignment of motor section 30 and pump section 50 may affect the amplitude, a calibration routine may be implemented to correlate the amplitude to the speed after installation of PMA 22. Fault control 102 also determines characteristics of the vibration signal. Based on the characteristics, fault control 102 can determine if a phase is missing from the three phase AC power supplying motor section 30. Using vibration transducer 136 for such determinations may be more cost effective than using CTs. In FIG. 9, like in pump control system 20, pump control system 20A has temperature transducers 161, 162, and vibration transducer 136 in or on PMA 22.

Figure 11:
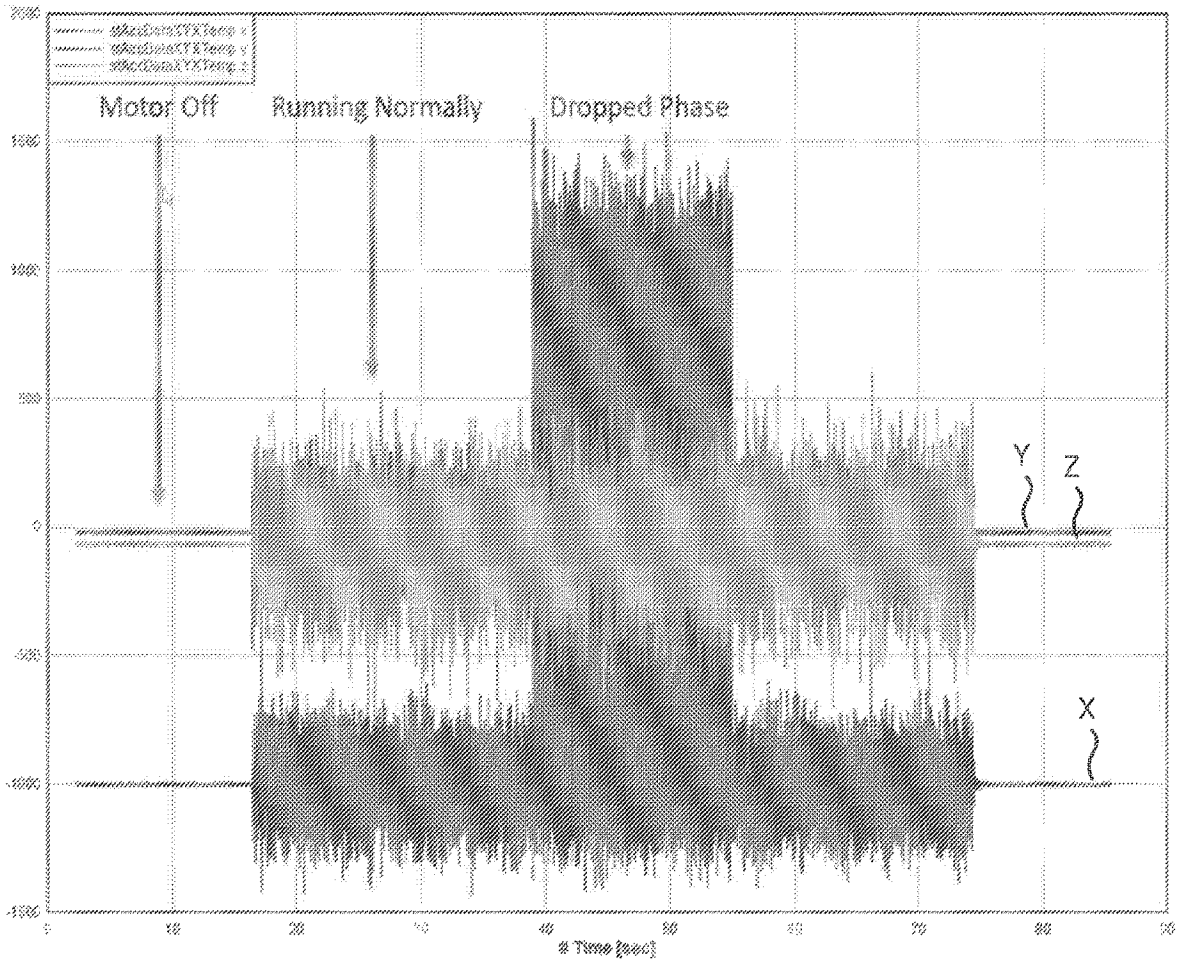
FIG. 11 is a graph depicting the amplitudes of vibration signals from a vibration sensor.

Referring to FIG. 10, in one embodiment pump control system 20B includes fault control system 100B including vibration transducer 136 located in fault control 102, as described with reference to FIG. 6B. Temperature transducers 161, 162 are mounted on the external surfaces of PMA 22 with signal conductors routed to fault control 102 without traversing through the housing. A single current transformer 160 is positioned in junction box 80 and electrically coupled to fault control 102. Fault control 102 is supported from adapter 40 and powered by controller power supply 166. Fault control 102 is configured to detect the speed of the motor (and pump) by analyzing the signal from CT 160 and to detect a phase loss or other faults by analyzing signals from vibration sensor 136 and temperature transducers 161, 162, as described below. FIG. 11 illustrates vibration signals X, Y, and Z from vibration transducer 136, e.g. a 3-axis accelerometer mounted in fault control 102. As shown, the amplitudes of signals X and Z are about the same while the amplitude of signal Y is significantly larger, indicating the loss of a phase. In the present example, the vibration signal from one axis is more than twice as large as the average of the amplitudes from the other two axes, indicating the loss of a phase. The phase difference may be indicated when the amplitude difference exceeds a difference threshold, for example when the difference is more that 50% of the smallest amplitude. In one example, the temperature sensor coupled to pump section 52 is positioned at least 2 inches below the top of pump section 52, which provides a temperature signal that is more responsive than if the sensor were positioned higher and is therefore more suitable to indicate faults.

Figure 12:
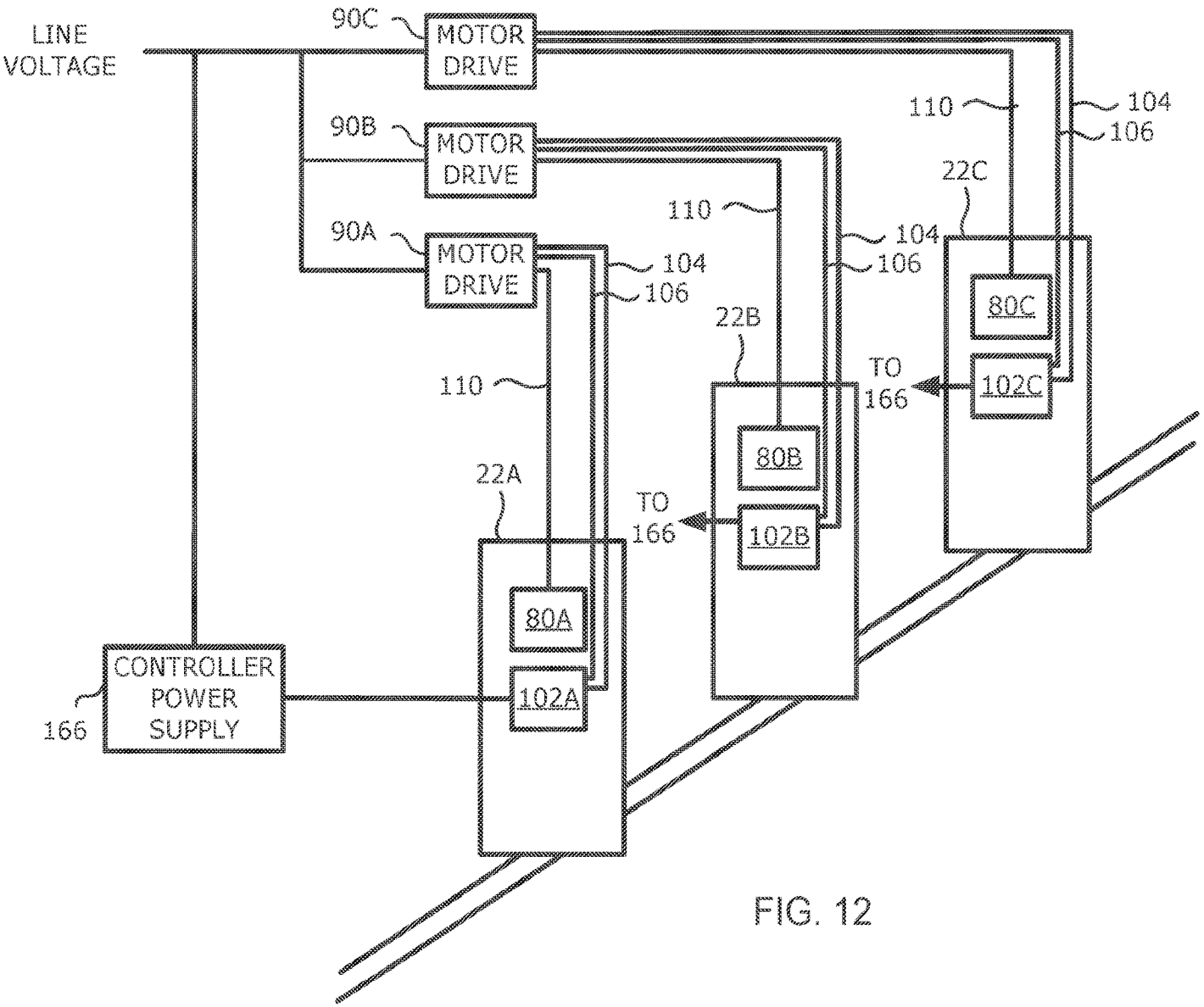
FIG. 12 is a block diagram of a booster system comprising a plurality of individually controlled pump-motor assemblies.

As indicated above, a plurality of PMAs may be connected to a common system. The plurality of PMAs may each be driven by a motor drive or, alternatively, a motor drive may drive several PMAs. Referring to FIG. 12, a booster system comprising a plurality of individually controlled PMAs 22A-22C is shown. The booster system is configured to increase the pressure of a liquid (e.g., water) being pumped through the system. Each of PMA 22A-22C includes a respective junction box (i.e., junction boxes 80A-80C) and a respective fault control (i.e., fault controls 102A-102C). Each PMA 22A-22C is driven by a respective motor drive (i.e., motor drives 90A-90C). Motor drives 90A-90C draw power from a line voltage (e.g., power source 148). Fault controls 102A-102C are powered by a controller power supply 166, which also draws power from the line voltage. As such, controller power supply 166 may include suitable circuits configured to convert AC power from the line voltage to DC power for fault controls 102A-102C. Each fault control 102A-102C is mounted on its respective PMA 22A-22C to monitor for faults. If a fault is detected, an alarm signal is transmitted over alarm signal wires 104 to the corresponding motor drive 90A-90C. If the detected fault merits a shutdown of the motor, an emergency stop signal is also transmitted over stop/run control wires 106 to the corresponding motor drive 90A-90C. Controller power supply 166 may also be supplied power from one of the motor drives, and be configured to receive voltage in the range of 100-460 VAC while converting the AC voltage to 24 VDC, for example.

Figure 13:
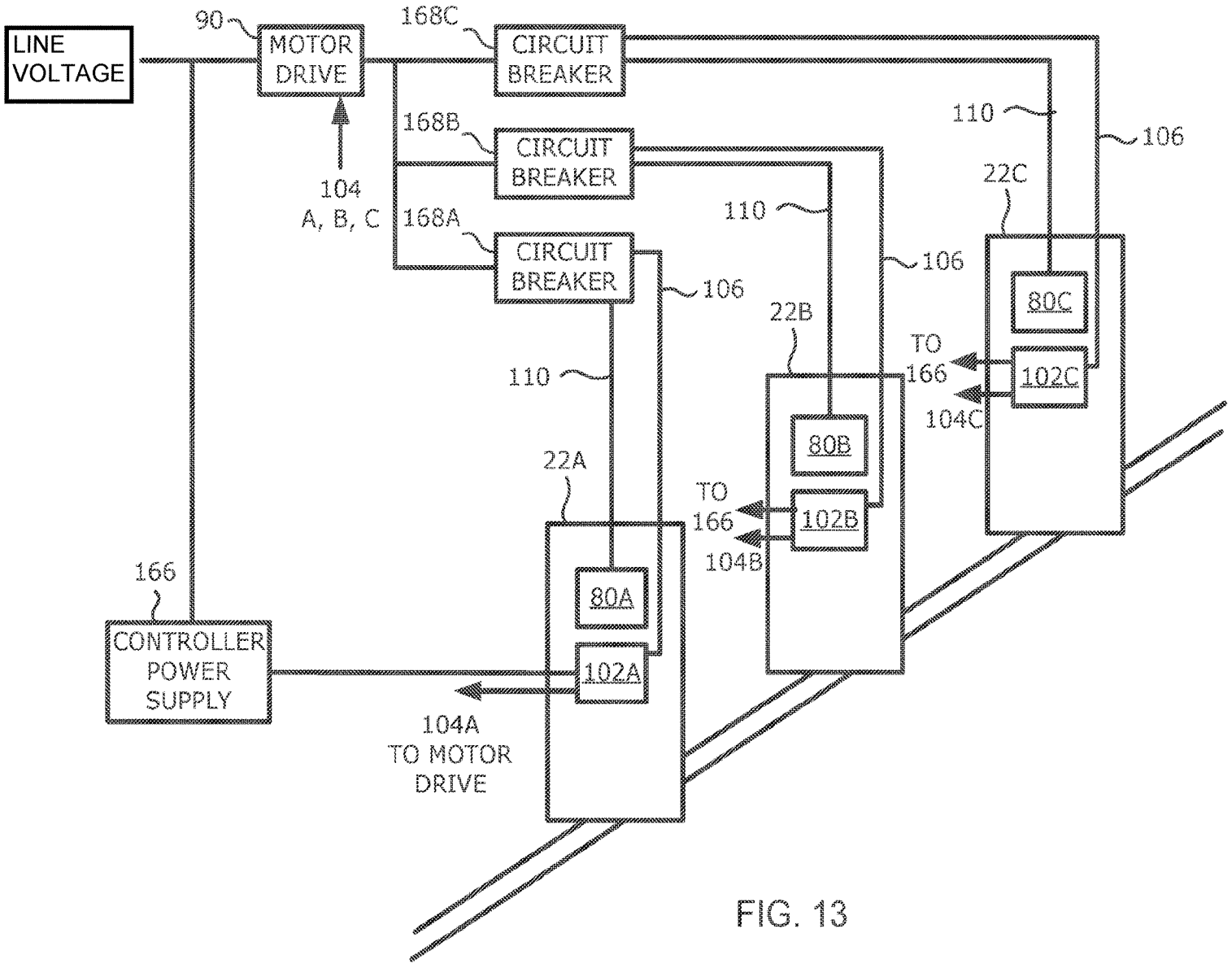
FIG. 13 is a block diagram of a booster system comprising a plurality of pump-motor assemblies driven by a common motor drive.

Referring to FIG. 13, a booster system comprising a plurality of PMAs 22A-22C driven by a common motor drive 90 is provided. Each PMA 22A-22C includes a respective junction box (i.e., junction boxes 80A-80C) and a respective fault control (i.e., fault controls 102A-102C). Common motor drive 90 draws power from a line voltage (e.g., power source 148), while fault controls 102A-102C are powered by a controller power supply 166. Fault controls 102A-102C are electrically connected to common motor drive 90 through a respective circuit breaker (i.e., circuit breakers 168A-168C) that sits intermediate to common motor drive 90 and PMAs 22A-22C. Each fault control 102A-102C is mounted on its respective PMA 22A-22C to monitor for faults. If a fault is detected, an alarm signal is transmitted over a respective alarm signal wire (i.e., alarm signal wires 104A-104C) to common motor drive 90. If the detected fault merits a shutdown of the motor, an emergency stop signal is also transmitted over stop/run control wires 106 to the corresponding circuit breaker 168A-168C.

Figure 14:
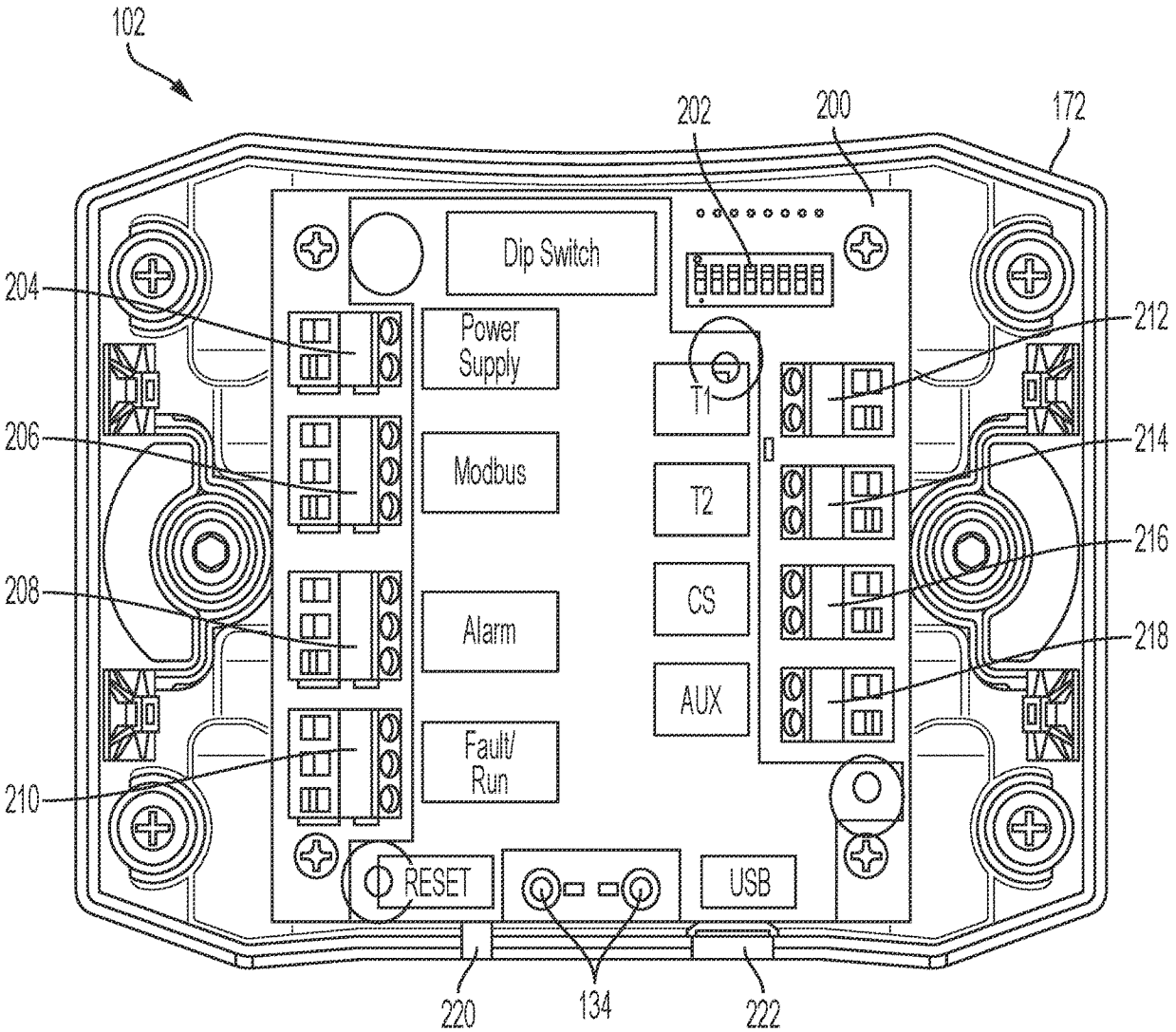
FIG. 14 is a front view of the fault control of FIG. 6A.

Referring first to FIG. 14, a front view of fault control 102 shows a panel 200 that includes a dip switch 202, a power supply connector 204, a Modbus connector 206, an alarm signal connector 208, a stop/run signal connector 210, temperature signal connectors 212, 214, a CT signal connector 216, an auxiliary signal connector 218, a reset switch 220, a Universal Serial Bus (USB) port 222, and LEDs 134.

Dip switch 202 allows a user to manually configure fault control 102 to select, for example, whether to enable or disable a particular fault. In one example, a user may disable vibration based faults. Power supply connector 204 allows fault control 102 to be connected to a power converter (e.g., controller power supply 166 in FIGS. 12 and 13) to receive AC or DC power. Modbus connector 206 allows fault control 102 to be connected to a peripheral device (e.g., HMI 156 in FIG. 1). Alarm signal connector 208 allows fault control 102 to be connected to motor drive 90, via alarm signal wires 104, to transmit an alarm signal when a fault is detected, or to a remote alarm indicator (not shown). Likewise, stop/run signal connector 210 allows fault control 102 to be connected to motor drive 90, via stop/run control wires 106, to transmit an emergency stop signal when a detected fault merits a shutdown of the motor. Temperature signal connectors 212, 214 allow fault control 102 to be connected to temperature transducers 161, 162 to receive temperature signals. Auxiliary signal connector 218 is provided to connect flow, pressure or other transducers. Reset switch 220 (shown as a button in FIG. 14) allows a user to manually reset certain of the faults, referred to as a "hard" reset. USB port 222 allows fault control 102 to be connected to an external USB device to specify functionality and configuration, implement a software (soft) fault reset, and display information such as firmware revision and historical data. LEDs 134 allow fault control 102 to visually indicate a detected fault.

Figure 15:
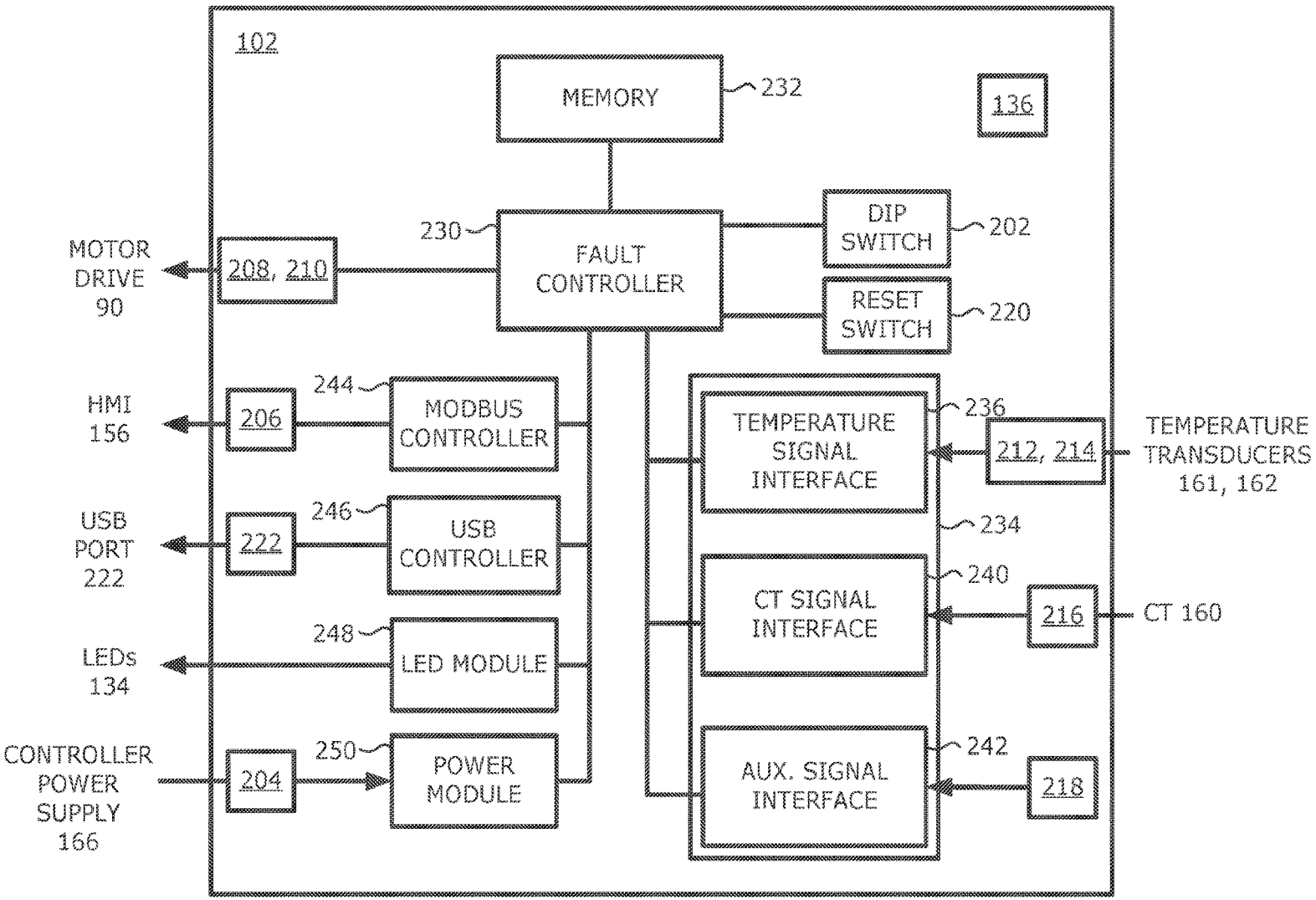
FIG. 15 is a block diagram of the fault control of FIG. 14.

Referring next to FIG. 15, a block diagram of fault control 102 includes a fault controller 230, a memory 232, and a signal input interface 234 with a temperature signal interface 236, a CS signal interface 240, and an auxiliary signal interface 242. The interfaces are coupled to various connectors, as described in FIG. 14 and shown in FIG. 15, and comprise well known circuit components configured to compatibilize the signals, e.g. voltage values from transducers, with the input requirements of fault controller 230. Compatibilization circuit components may include filters comprising capacitors and resistors. The components may also be arranged to integrate or smooth the signals and to block voltage spikes. Fault controller 230 may comprise ADCs coupled to its inputs to digitize the signals obtained from the interfaces. In the present embodiment the vibration sensor is mounted on fault control 102 and connected to fault controller 230 (connection not shown).

Fault controller 230 comprises control logic structured to evaluate the transducer data obtained from the signals by comparing the data to predetermined threshold values stored in memory 232. A fault is detected by fault controller 230 as described above and further below. Fault controller 230 outputs an alarm signal to motor drive 90 (via connector 208) in response to detecting a fault. Fault controller 230 also outputs an emergency stop signal to motor drive 90 (via connector 210) if the detected fault is serious enough to warrant a shutdown of the motor.

Table 1 lists the various types of faults that can be detected by fault controller 230.

TABLE 1

| Fault Type | Maximum Off Time | Priority | Reset | Recovery |
|---|---|---|---|---|
| Over-temperature | 10 min. | 1 | Soft | 2° C. |
| Deadhead | N/A | 2 | Soft | Absolute recovery |
| Blocked inlet | N/A | 3 | Soft | Absolute recovery |
| Low speed | N/A | 4 | Soft | 5 Hz increase for alarm to clear |
| Vibration | N/A | 5 | Hard | Infinite |
| Cooling flow | N/A | 6 | Soft | Absolute recovery |
| High cycles | N/A | 7 | Soft | Absolute recovery |

Table 1 illustrates operation of one embodiment of firmware of controller 230. In this embodiment faults are prioritized and the highest level fault that occurs is shown via LEDs 134. The faults reset themselves (soft reset) or require user input (hard reset). Absolute recovery indicates that the fault indication is automatically rescinded when the fault conditions disappears. In the case of over-temperature, controller 230 shuts the drive down, which prevents water circulation and therefore reduces cooling that would cause more rapid recovery than air cooling, which occurs without the drive running. Thus, in the present embodiment controller 230 restarts the drive every 10 minutes to increase cooling. If the temperature falls 2° C. controller 230 determines that the cause of the fault is no longer present and continues running. If the condition remains controller 230 shuts down the drive for another 10 minutes.

An over-temperature fault occurs when an overall temperature in PMA 22 is above a safe running threshold. Factors that contribute to over-temperature may include blocked outlet, blocked inlet, insufficient cooling, high inlet water temperature, etc. To detect an over-temperature fault, fault controller 230 evaluates temperature signals as measured by temperature transducers 161, 162 to determine if the overall temperature in PMA 22 has exceeded a predetermined threshold value (stored in memory 232). In evaluating the temperature signals, fault controller 230 may employ a moving average acting as an integrator to prevent any nuisance tripping.

A deadhead fault occurs when pump section 50 is running but cannot move the liquid being pumped due to discharge port 62 being blocked. A blocked inlet fault occurs when pump section 50 is running but cannot move the liquid being pumped due to inlet port 26 being closed. A cooling flow fault occurs when motor section 30 is running but cannot move enough liquid to cool down PMA 22. These types of faults can lead to an increased temperature in motor section 30 and/or pump section 50 due to a lack of liquid flow that removes excess heat.

A low speed fault occurs when a minimum speed for motor section 30 is set too low, which forces motor section 30 and pump section 50 to run at speeds lower than what is recommended. This fault can lead to rapidly increasing temperatures as well as grinding within the motor bearing due to insufficient lubrication. Running a motor in this condition will significantly reduce the life of the motor. To detect a low speed fault, fault controller 230 evaluates CT signals as measured by CTs 160A-160C and/or vibration signals as measured by vibration transducer 136 to determine if the speed of motor section 30 is less than a predetermined minimum speed (stored in memory 232). Fault controller 230 may reference previously stored speed values to prevent any nuisance tripping. For example, some fault parameters are based on moving averages. Other fault parameters are based on the fault condition having a predetermined duration before a fault is determined to have occurred.

A vibration fault occurs when PMA 22 vibrates excessively due to bearing wear, bearing failure, pump failure, electrical imbalance, or mechanical misalignment. To detect a vibration fault, fault controller 230 evaluates vibration signals as measured by vibration transducer 136 to determine if the vibration amplitude exceeds a predetermined threshold value (stored in memory 232). Fault controller 230 may reference previously stored vibration values to prevent any nuisance tripping. A high cycles fault occurs when motor section 30 has too many starts within a given period. Excessive cycling of motor section 30 can be indicative of another problem, e.g. a system problem, and can lead to a reduction in the life of the motor. To detect a high cycles fault, fault controller 230 evaluates CT signals as measured by CTs 160A-160C and/or vibration signals as measured by vibration transducer 136 to determine a start of the motor. In one example, a start is determined if the speed of the motor exceeds a low value, for example zero. In another example, a start is determined if vibrations exceed a baseline measured when the motor is not in operation. Based on the start information, fault controller 230 sets up a counter to track each motor start. For example, fault controller 230 can store up to ten values of motor start (e.g., in memory 232), and then analyze the stored values to determine if an average cycle time is shorter than a recommended time. As another example, fault controller 230 can determine if a time duration, which can be a moving average, between each motor start is less than a restart time threshold. In one example, a duration of 5 minutes or less between starts is indicative of a fault. In another example, a rate of 300 starts per day is indicative of a fault.

Referring back to FIG. 15, fault control 102 also includes dip switch 202 for manually configuring fault controller 230 to select . . . , and reset switch 220 for manually initiating a reset operation to clear an existing emergency stop. Further, fault control 102 includes a Modbus controller 244 comprising control logic structured to control communication with HMI 156 (via connector 206), a USB controller 246 comprising control logic structured to control communication with an external USB device (via port 222), a LED module 248 comprising suitable circuits operable to activate/deactivate LEDs 134, and a power module 250 comprising suitable circuits operable to receive AC or DC power (via connector 204).

When a fault is detected, LED module 248 is configured to cause LEDs 134 to flash different colors to indicate the detected fault type. In one embodiment, LEDs 134 may include two LEDs (e.g., LED 1 and LED 2). Table 2 lists the different flashes for LED 1 and LED 2 based on the detected fault type.

TABLE 2

| Signal | Fault Type | LED 1 | LED 2 |
|---|---|---|---|
| No Fault | No fault | Green - always on | Always off |
| Emergency stop signal | Over-temperature | Red - always on | Flash red 1 time at 1 Hz |
| | Low speed | Red - always on | Flash red 4 time at 1 Hz |
| | Vibration | Red - always on | Flash red 5 time at 1 Hz |
| Alarm signal | Over-temperature | Yellow - always on | Flash red 1 time at 1 Hz |
| | Deadhead | Yellow - always on | Flash red 2 times at 1 Hz |
| | Blocked inlet | Yellow - always on | Flash red 3 times at 1 Hz |
| | Low speed | Yellow - always on | Flash red 4 times at 1 Hz |
| | Vibration | Yellow - always on | Flash red 5 times at 1 Hz |
| | Cooling flow | Yellow - always on | Flash red 6 times at 1 Hz |
| | High cycles | Yellow - always on | Flash red 7 times at 1 Hz |

In various embodiments, the term "control logic" includes software and/or firmware executing on one or more programmable processors, application-specific integrated circuits, field-programmable gate arrays, digital signal processors, hardwired logic, or combinations thereof. Therefore, in accordance with the embodiments, various control logic may be implemented in any appropriate fashion and would remain in accordance with the embodiments herein disclosed. As used herein, memory (e.g., memory 232) may include random access memory (RAM), read-only memory (ROM), erasable programmable read-only memory (e.g., EPROM, EEPROM, or Flash memory), or any other tangible medium capable of storing information.

Figure 16:
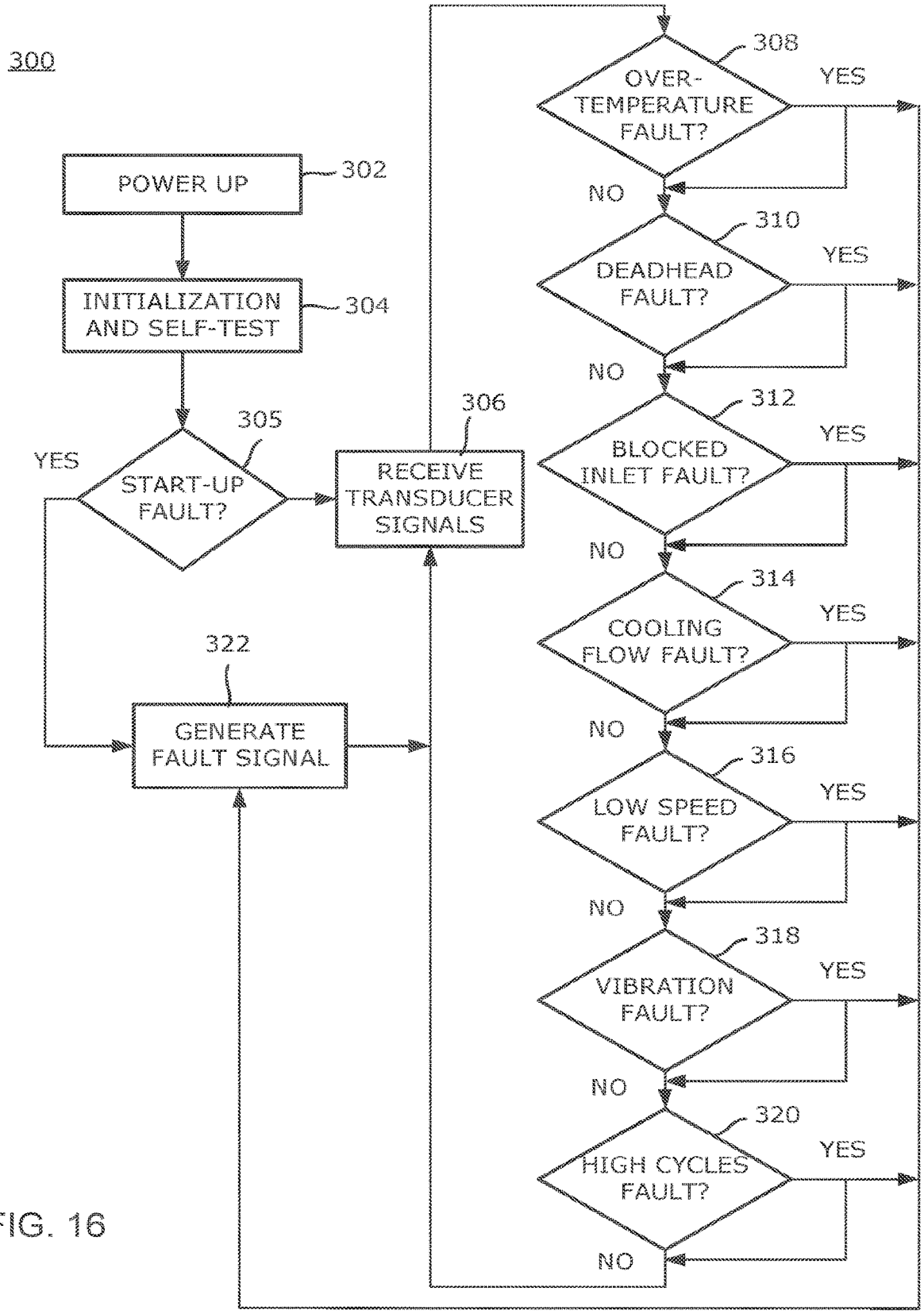
FIG. 16 is a flowchart of an embodiment of a fault protection method implemented by the fault control of FIG. 14.

Referring now to FIG. 16, a flowchart of a fault protection method 300 implemented by fault control 102 is provided. The method may be implemented by processing instructions stored in memory (e.g., memory 232) and implemented by a controller (e.g., fault controller 230). The method begins, at 302, with a power up (e.g., by receiving power through controller power supply 166). The method continues, at 304, with an initialization and self-test routine to confirm proper operation of the controller. If operation is not proper because a start-up fault is detected, at 305, then a fault is indicated, at 322. The method then continues, at 306, by receiving transducer signals from various transducers as described above.

The method evaluates the received transducer signals to determine if a fault occurred. In particular, the method retrieves predetermined thresholds stored in memory (e.g., memory 232) and compares the received transducer signals to the stored thresholds. At 308-314, the method detects an over-temperature fault, a deadhead fault, a blocked inlet fault, and a cooling flow fault, respectively, by comparing received temperature signals (as measured by temperature transducers 161, 162) to temperature thresholds stored in memory 232. A fault is detected if the received temperature signals exceed the stored temperature thresholds.

At 316, the method detects a low speed fault by determining a speed for motor section 30 from received CT signals and/or received vibration signals (as measured by vibration transducer 136), and comparing the determined speed to a minimum speed stored in memory 232. A fault is detected if the determined speed is less than the stored minimum speed.

At 318, the method detects a vibration fault by determining a magnitude of vibration from received vibration signals (as measured by vibration transducer 136), and comparing the determined magnitude of vibration to a vibration threshold stored in memory 232. A fault is detected if the determined magnitude of vibration exceeds the stored vibration threshold. The fault may represent a loss of phase or a mechanical problem.

At 320, the method detects a high cycles fault by determining and tracking a speed for motor section 30 from received CT signals and/or received vibration signals (as measured by vibration transducer 136). The tracked speeds are saved in memory 232. A fault is detected if an average cycle time computed from the saved speeds is shorter than a predetermined threshold time (stored in memory 232).

If a fault is detected at any of 308-320, the method continues, at 322, to generate a fault signal. The fault signal may be an alarm signal sent to motor drive 90 or a remote indicator or HMI to alert an operator. If a detected fault merits a shutdown of motor section 30, the fault signal may be an emergency stop signal sent to motor drive 90 to stop motor drive 90 from supplying power to motor section 30. The method may also indicate the detected fault by flashing LEDs (e.g., LEDs 134).

FIGS. 17 and 18 illustrate alternative embodiments of PMA 22. In FIG. 17, a housing adapter may comprise a collar devoid of flanges. In FIG. 18, a hole and a junction box coupler are incorporated with the discharge adapter in a one-piece component of PMA 22.

The scope of the invention is to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The embodiments and examples described above may be further modified within the spirit and scope of this disclosure. This application covers any variations, uses, or adaptations of the invention within the scope of the claims.

What is claimed is:

1. A fault control for a pump-motor assembly including a motor mechanically coupled to a pump, the motor powered by a motor drive, the fault control comprising:

a sensor mounted on the pump-motor assembly to sense a characteristic of the pump-motor assembly, the sensor comprising a first temperature transducer adjacent to the motor to sense a first temperature and a second temperature transducer adjacent to the pump to sense a second temperature, the sensor configured to generate signals corresponding to the first temperature and the second temperature; and a fault controller structured to generate a fault signal for the motor drive upon determining, based on a temperature difference between the first temperature and the second temperature, that a fault occurred;

wherein the fault is a flow loss fault comprising a loss of inlet flow if the temperature difference has a first polarity and a loss of discharge flow if the temperature difference has a second polarity opposite the first polarity.

2. The fault control of claim 1, wherein the fault controller is in a housing mounted on the pump-motor assembly.

3. The fault control of claim 1, wherein the flow loss fault comprises a loss of inlet flow if an absolute value of the temperature difference is greater than a temperature threshold and a temperature gradient is greater than a speed-dependent threshold, wherein the temperature gradient corresponds to a rate of change of the temperature.

4. The fault control of claim 1, wherein the fault controller is structured to determine that the fault occurred if the second temperature exceeds a temperature threshold.

5. The fault control of claim 4, wherein the temperature threshold is about 40° C.

6. The fault control of claim 1, wherein the fault controller is structured to determine that the fault occurred if a rate of change of the second temperature exceeds a rate of change threshold.

7. The fault control of claim 6, wherein the rate of change threshold is about 0.5° C. per minute.

8. The fault control of claims 1, wherein the motor drive supplies power comprising three phases, further comprising a vibration transducer mounted on the pump-motor assembly to generate a vibration signal, and wherein the fault controller is structured to determine, from the vibration signal, if at least one of the three phases is missing and to generate the fault signal upon determining that at least one of the three phases is missing.

9. The fault control of claim 8, wherein the motor is within a motor section connected to a housing adapter, and the pump is within a pump section connected to the housing adapter, which is positioned intermediate the pump section and the motor section, further comprising a housing supported by the housing adapter, and a circuit board in the housing, wherein the fault controller is mounted onto the circuit board.

10. The fault control of claim 8, wherein the fault controller is structured to determine if an amplitude of the vibration signal exceeds a predetermined threshold and to determine that a vibration fault has occurred if the amplitude exceeds the predetermined threshold.

11. A fault control for a pump-motor assembly including a motor mechanically coupled to a pump, the motor powered by a motor drive, the fault control comprising:

a sensor mounted on the pump-motor assembly to sense a characteristic of the pump-motor assembly, the sensor comprising a first temperature transducer adjacent to the motor to sense a first temperature and a second temperature transducer adjacent to the pump to sense a second temperature, the sensor configured to generate signals corresponding to the first temperature and the second temperature; and a fault controller structured to generate a fault signal for the motor drive upon determining, based on the first temperature and/or the second temperature, that a fault occurred;

wherein the motor drive supplies power comprising three phases, further comprising a vibration transducer mounted on the pump-motor assembly to generate a vibration signal, and wherein the fault controller is structured to determine, from the vibration signal, if at least one of the three phases is missing and to generate the fault signal upon determining that at least one of the three phases is missing; and wherein the fault controller is further structured to determine a speed of the motor based on signals generated by the vibration transducer and to generate a fault signal if the speed is less than a minimum speed that is greater than zero.

12. A pump-motor assembly comprising:

a pump;

a motor mechanically connected to the pump; and a fault controller including:

a first temperature transducer adjacent to the motor and configured to sense a first temperature; and a second temperature transducer adjacent to the pump and configured to sense a second temperature, wherein the fault controller is structured to generate a fault signal for a motor drive adapted to power the motor upon determining, based on a temperature difference between the first temperature and the second temperature, that a fault occurred;

wherein the fault is a flow loss fault comprising a loss of inlet flow if the temperature difference has a first polarity and a loss of discharge flow if the temperature difference has a second polarity opposite the first polarity.

13. The pump-motor assembly of claim 12, comprising an inlet port, a motor section, and a pump section, wherein the motor section is intermediate the inlet port and the pump section, and a discharge port, wherein the pump section is intermediate the motor section and the discharge port.

14. The pump-motor assembly of claim 13, wherein the motor of the pump-motor assembly is cooled by liquid pumped through from the inlet port to the discharge port of the pump-motor assembly.

15. The pump-motor assembly of claim 12, wherein the first temperature sensor is positioned adjacent the pump and the second temperature sensor is mounted on the motor section adjacent the pump section.

16. A fault control for a pump-motor assembly including a motor mechanically coupled to a pump, the fault control comprising:

a first temperature transducer adjacent to the motor and configured to sense a first temperature;

a second temperature transducer adjacent to the pump and configured to sense a second temperature; and a fault controller structured to generate a fault signal indicative of a flow loss based on a difference between the first temperature and the second temperature;

wherein the fault signal indicates a loss of inlet flow if the difference has a first polarity and a loss of discharge flow if the difference has a second polarity opposite the first polarity.

17. The fault control of claim 16, wherein the fault controller is mounted on the pump-motor assembly, and wherein the fault signal is adapted to stop operation of a motor drive electrically coupled to the motor by the power lines to power the motor.

18. A fault control for a pump-motor assembly including a motor mechanically coupled to a pump, the motor powered by a motor drive, the fault control comprising:

a sensor mounted on the pump-motor assembly to sense a characteristic of the pump-motor assembly, the sensor comprising a first temperature transducer adjacent to the motor to sense a first temperature and a second temperature transducer adjacent to the pump to sense a second temperature, the sensor configured to generate signals corresponding to the first temperature and the second temperature; and a fault controller structured to generate a fault signal for the motor drive upon determining, based on the first temperature and/or the second temperature, that a fault occurred;

wherein the fault controller is further structured to determine a speed of the motor based on signals generated by a vibration transducer and to generate a speed fault signal if the speed is less than a minimum speed that is greater than zero.

* * * * *